United States Patent [19]

Iseki et al.

[11] Patent Number: 4,685,792

[45] Date of Patent: Aug. 11, 1987

[54] COPYING PAPER FEED DEVICE FOR AN ELECTROSTATIC COPYING APPARATUS

[75] Inventors: Masahide Iseki, Neyagawa; Toshio Yoshiyama, Sakai; Hiroshi Kajita, Kobe; Masanori Itakiyo, Sakai; Hiroshi Kusumoto, Takaishi; Yoshizo Kawamori, Fujiidera; Masuo Kawamoto, Daito, all of Japan

[73] Assignee: Mita Industrial Co., Ltd., Japan

[21] Appl. No.: 772,487

[22] Filed: Sep. 4, 1985

Related U.S. Application Data

[62] Division of Ser. No. 551,794, Nov. 15, 1983, Pat. No. 4,555,173.

[30] Foreign Application Priority Data

Nov. 30, 1982 [JP] Japan ..... 57-209849

[51] Int. Cl.[4] ..... G03G 15/00

[52] U.S. Cl. ..... 355/3 SH; 355/3 R; 355/14 SH; 271/127; 271/164

[58] Field of Search ..... 355/3 SH, 14 SH, 14 R, 355/3 R; 271/127, 164, 170, 171, 256, 258, 145

[56] References Cited

U.S. PATENT DOCUMENTS

| | | | |
|---|---|---|---|
| 4,354,759 | 10/1982 | Bujese | 355/3 SH |
| 4,390,264 | 6/1983 | Murata et al. | 355/3 SH X |
| 4,472,049 | 9/1984 | Honma et al. | 355/3 SH X |
| 4,505,571 | 3/1985 | Kimura et al. | 355/3 SH |

*Primary Examiner*—A. C. Prescott

*Attorney, Agent, or Firm*—Beveridge, DeGrandi & Weilacher

[57] ABSTRACT

A copying paper feed device for an electrostatic copier. A copying paper cassette receiving section is adapted to receive a copying paper cassette having a box-like case with a bottom plate the front end of which is biased upwardly by a spring. Within the cassette receiving section, a feed roller is mounted on a rotatable shaft that is adapted to be connected to a drive source. When the copying paper cassette is properly loaded into the cassette receiving section, the front end of the uppermost sheet of copying paper contacts the feed roller. A clutch in its operating condition links the feed roller with the drive source and in its non-operating condition permits the feed roller to freely rotate.

4 Claims, 27 Drawing Figures

FIG. 12-A
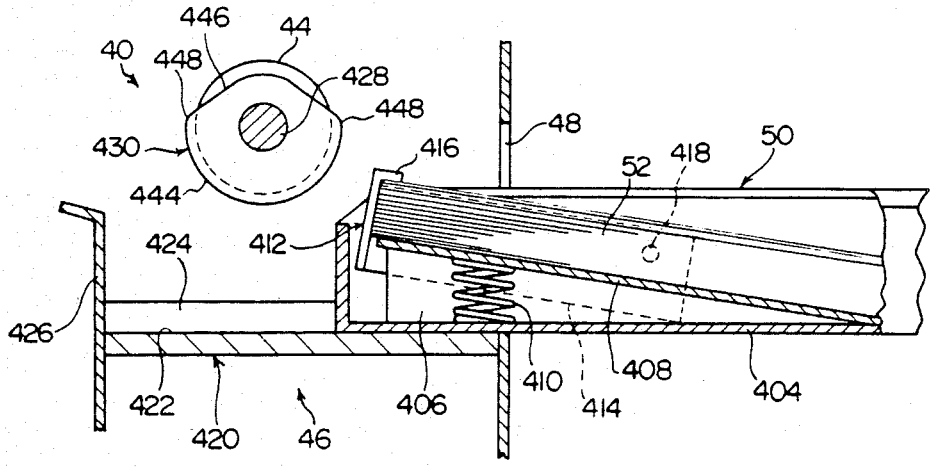
FIG. 12-B
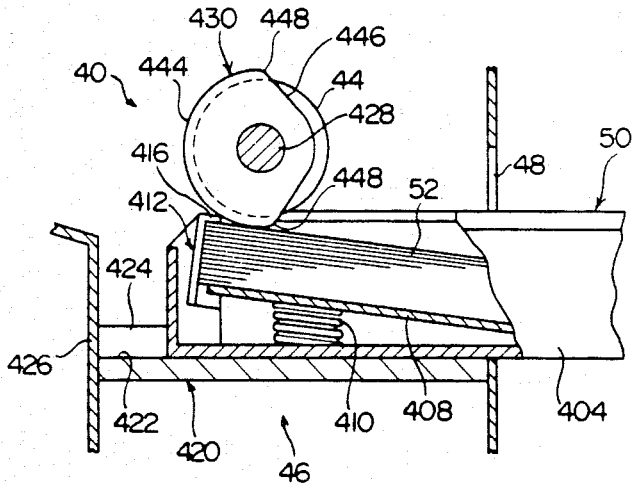

FIG. 12-C
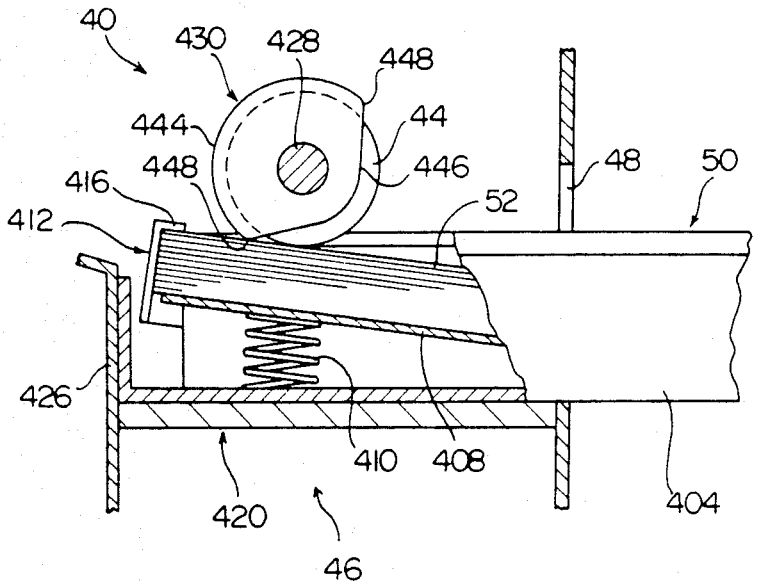

COPYING PAPER FEED DEVICE FOR AN ELECTROSTATIC COPYING APPARATUS

This is a division, of application Ser. No. 551,794, filed Nov. 15, 1983, now U.S. Pat. No. 4,555,173.

FIELD OF THE INVENTION

This invention relates to some improvements in an electrostatic copying apparatus, particularly a shell-type electrostatic copying apparatus.

DESCRIPTION OF THE PRIOR ART

As is well known to those skilled in the art, electrostatic copying apparatuses of the so-called shell-type which have a first and a second supporting frames connected to each other so that they can pivot relative to each other between an open position and a closed position (usually, a lower supporting frame disposed at a predetermined position and an upper supporting frame mounted on the lower supporting frame for pivotal movement between an open position and a closed position) have already been proposed and come into commercial acceptance. Generally, in such a shell-type electrostatic copying apparatus, at least a considerable portion of a conveying passage for a sheet material such as a copying paper on which to form a copied image is opened by relatively pivoting the first and second supporting frames to bring them to the open position. Hence, this offers the advantage that in the event that jamming occurs in the conveying passage, the sheet material can be easily taken out from it. The conventional shell-type electrostatic copying apparatuses, however, still have problems to be solved, among which are:

(1) linking and disengaging of a drive power source provided in one of the first and second supporting frames to and from a power transmission system provided in the other cannot be fully smoothly effected according to the relative opening and closing movement of the first and second supporting frames; and (2) mounting and detaching of a rotating drum detachably mounted on an upper supporting frame which is mounted for free pivotal movement between an open position and a closed position on a lower supporting frame disposed at a predetermined position, and mounting and detaching of a cleaning device, a charging corona discharge device and a developing device located around the rotating drum cannot be achieved fully easily and rapidly.

Generally, electrostatic copying apparatuses, not limited to those of the shell-type described above, include a fixing device for fixing a toner image on the surface of a sheet material such as a copying paper, a mechanism for conveying the sheet material as required, and a paper feeding device of the cassette type. Conventional electrostatic copying apparatuses also have problems to be solved with regard to these devices. The following are typical of these problems.

(3) In a fixing device of the type including a pair of cooperating fixing rollers, the fixing rollers remain in press contact with each other even when the drive power source is deenergized and the fixing rollers are not rotating. Accordingly, if one of the fixing rollers is made of a flexible material, inconveniences such as the generation of localized strain in the fixing rollers occur.

(4) The sheet conveying mechanism is not fully simple and inexpensive in view of its required function.

(5) In the cassette-type paper feeding device, the uppermost sheet in a layer of sheets in the cassette is adversely affected by a paper feed roller at the time of loading and removing the cassette.

(6) In a fixing device of the type including a pair of fixing rollers at least one of which includes an electrical heating element, the heating element tends to consume power excessively and the fixing rollers tend to be adversely affected by the toner which remains adhering to the fixing rollers.

SUMMARY OF THE INVENTION

A first object of this invention is to provide an improved electrostatic copying apparatus of the aforesaid shell-type in which linking and desengagement of a drive power source provided in one of a first and a second supporting frames to and from a power transmission system provided in the other are achieved very smoothly according to the relative opening and closing movements of the first and second supporting frames.

A second object of this invention is to provide an improved electrostatic copying apparatus of the aforesaid shell-type in which mounting and detaching of a rotating drum on an upper supporting frame mounted for free pivotal movement between an open position and a closed position on a lower supporting frame disposed at a predetermined position, and mounting and detaching of a cleaning device, a charging corona discharge device and a developing device located around the rotating drum are achieved fully easily and rapidly.

A third object of this invention is to provide an improved fixing device in which a pair of fixing rollers are maintained in press contact with each other upon energization of a drive power source, and are at least partly moved away from each other upon deenergization of the drive power source.

A fourth object of this invention is to provide an improved sheet conveying mechanism which can perform its required function in spite of its much simpler structure and lower cost than conventional sheet conveying mechanisms.

A fifth object of this invention is to provide an improved copying paper feed device in which at the time of loading and removing a copying paper cassette, the uppermost sheet of a layer of copying paper sheets in the cassette is prevented from being adversely affected by feed rollers.

A sixth object of this invention is to provide an improved electrostatic copying apparatus in which excessive consumption of power by an electrical heating element in a fixing device is inhibited and fixing rollers are prevented from being adversely affected by a toner which remains adhering to the fixing rollers.

Other objects of this invention will become apparent from the following description.

According to a first aspect of this invention, there is provided an electrostatic copying apparatus having a first and a second supporting frames connected to each other for relative pivotal movement between an open position and a closed position, wherein the first supporting frame has provided therein a rotatably mounted interlocking input gear and a first power transmission system drivingly connected to the interlocking input gear;

the second supporting frame has provided therein a drive source, a second power transmission system drivingly connected to the drive source, and a rotatably mounted interlocking output gear drivingly connected to the drive source;

a pivot member mounted for free pivotal movement about the central axis of rotation of the interlocking input gear or the interlocking output gear and held elastically at a predetermined angular position by a spring means is provided in the first supporting frame or the second supporting frame, and an interlocking linking gear is rotatably mounted on the pivot member;

when the pivot member is provided in the first supporting frame, the interlocking linking gear is in mesh with the interlocking input gear, and the interlocking input gear is drivingly connected to the first power transmission system so that it can freely rotate over a slight angular range with respect to the first power transmission system;

when the pivot member is provided in the second supporting frame, the interlocking linking gear is in mesh with the interlocking output gear, and the interlocking output gear is drivingly connected to the drive source so that it can rotate freely over a slight angular range with respect to the drive source; and when the first and second supporting frames are relatively pivoted to the closed position, the interlocking linking gear is brought into mesh with the interlocking output gear or the interlocking input gear and as a result, the drive source is drivingly connected to the first power transmission system through the interlocking output gear, the interlocking linking gear and the interlocking input gear.

According to a second aspect of this invention, there is provided an electrostatic copying apparatus including a lower supporting frame and an upper supporting frame mounted on the lower supporting frame for free pivotal movement about the central axis of pivoting extending in the front-rear direction between an open position and a closed position, the upper supporting frame having a rotating drum with a photosensitive material on its peripheral surface mounted thereon for free rotation about the central axis of rotation extending in the front-rear direction, and further including a cleaning device, a charging corona discharge device and a developing device mounted around the rotating drum in this order viewed in the rotating direction of the rotating drum; wherein the rotating drum and the developing device are mounted on a first unit frame and constitute a first unit, the cleaning device and the charging corona device are mounted on a second unit frame and constitute a second unit, and the first unit frame and the second unit frame are each mounted detachably on the upper supporting frame.

According to a third aspect of this invention, there is provided a fixing device for fixing a toner image on the surface of a sheet material comprising a rotatably mounted driven fixing roller drivingly connected to a drive source and a rotatably mounted follower fixing roller; wherein at least one end of the follower fixing roller is mounted on a movable supporting member mounted for free movement between a press-contacting position at which the follower fixing roller is maintained in press-contact with the driven fixing roller and an isolated position at which at least a greater portion of the follower fixing roller in its longitudinal direction is isolated from, or maintained out of press contact with, the driven fixing roller, and a press-contacting control mechanism is provided which moves the movable supporting member to the press-contacting position upon energization of the drive source and to the isolated position upon deenergization of the drive source.

According to a fourth aspect of this invention, there is provided a sheet material conveying mechanism comprising a rotatably mounted driven shaft drivingly connected to a drive source, a plurality of conveying rollers mounted on the driven shaft in spaced-apart relationship in the longitudinal direction of the driven shaft, and a plurality of stationary guide members each located opposite to the driven shaft and between the adjacent conveying rollers, the distance between the lower edge of each guide member and the peripheral surface of the driven shaft being slightly shorter than the distance between the peripheral surface of the driven shaft and the peripheral surface of each conveying roller.

According to a fifth aspect of this invention, there is provided a copying paper feed device in an electrostatic copying apparatus, said device comprising a combination of a copying paper cassette and a copying paper cassette receiving section permitting loading of the cassette therein by inserting at least the front end portion of the cassette, the paper cassette including a box-like cassette case opened at least at the front end portion of its upper surface, a bottom plate disposed within the cassette case and on which to place a layer of copying paper sheets, and a spring means for elastically biasing the front end portion of the bottom plate upwardly, the cassette receiving section having provided therein a rotatably mounted rotating shaft drivingly connected to a drive source and a feed roller mounted on the rotating shaft, and said device being of the type in which when the copying paper cassette is loaded in position into the cassette receiving section, the front end portion of the uppermost copying paper in the sheet-like copying paper layer is brought into press contact with the feed roller by the elastic biasing action of the spring member; wherein the feed roller is fixed to the rotating shaft and a clutch means and a rotating input element drivingly connected to the drive source are interposed between the rotating shaft and the drive source, and the clutch means in an operating condition links the rotating input element to the rotating shaft so as to rotate the rotating shaft in the feeding direction incident to the rotation of the rotating input element, and in a non-operating condition, the clutch means permits the rotating shaft to rotate freely in the feeding direction and in the reverse direction with respect to the rotating input element.

According to a sixth aspect of this invention, there is provided an electrostatic copying apparatus equipped with a heat fixing device having a pair of fixing rollers for cooperatively fixing a toner image to the surface of a sheet material, one of the fixing rollers being drivingly connected to a drive source and at least one of the fixing rollers including an electrical heating element; wherein said apparatus comprises a starting means which produces a power supply closing signal when a power switch is closed, a first temperature detector which detects the temperature of the fixing rollers and when the detected temperature reaches a first predetermined temperature $T_1$, produces a first temperature reaching signal, a second temperature detector which detects the temperature of the fixing rollers and when the detected temperature reaches a second predetermined temperature $T_2$ suitable for fixing and higher than the first predetermined temperature $T_1$, produces a second temperature reaching signal, a condition setting means which includes a preheating switch and produces either a normal condition signal or a pre-heated condition signal in response to the actuation of the pre-heating switch, a driving control means for controlling the operation of the drive source, and a heating control means for controlling the operation of the heating element;

when the starting means produces the power supply closing signal, the heating control means begins to energize the heating element, and in a condition in which the condition setting means is producing the normal condition signal, the heating control means energizes the heating element when the second temperature detector produces the second temperature reaching signal and deenergizes it when the second temperature reaching signal 1 disappears, and in a condition in which the condition setting means is producing the pre-heated condition signal, the heating control means deenergizes the heating element when the first temperature detector produces the first temperature reaching signal and energizes it when the first temperature reaching signal disappears; and when the condition setting means produces the normal condition signal and the first temperature detector produces the first temperature reaching signal, the driving control means energizes the drive source until the second temperature detector produces the second temperature reaching signal.

BRIEF DESCRIPTION OF THE DRAWINGS

FIGS. 12-A, 12-B and 12-C are partial sectional views showing in various states a copying paper feed device in the copying apparatus shown in FIG. 1;

Figure 1:
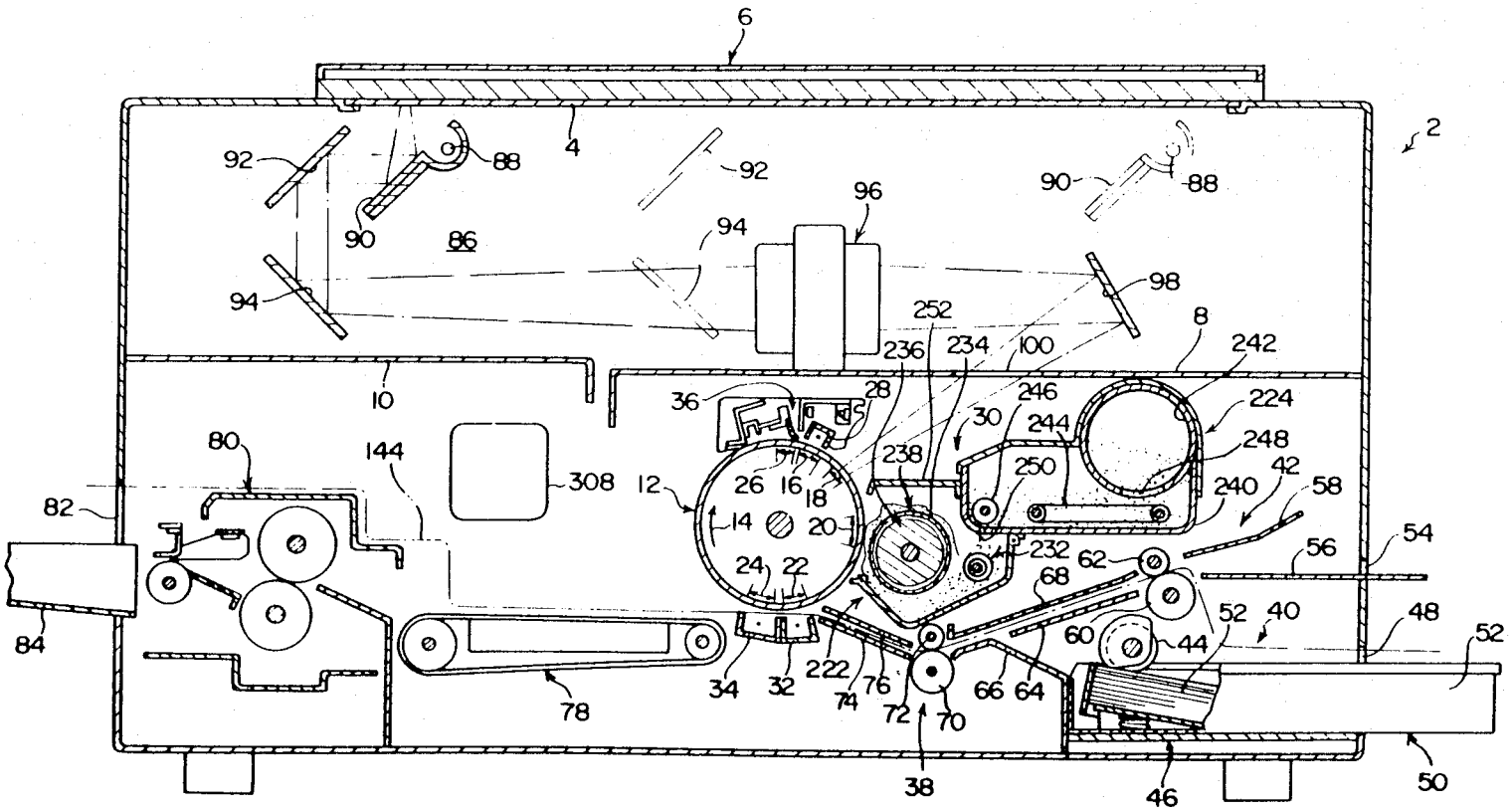
FIG. 1 is a simplified sectional view showing the general/construction of an electrostatic copying apparatus improved in various points in accordance with this invention.

DETAILED DESCRIPTION OF PREFERRED EMBODIMENTS OUTLINE OF THE COPYING APPARATUS AS A WHOLE

First of all, the general construction of the copying apparatus is described with reference to FIG. 1 which is a simplified sectional view of one embodiment of the electrostatic copying apparatus improved in various points in accordance with this invention.

The illustrated copying apparatus has a nearly rectangular parallelpipedal housing shown generally at 2. A transparent plate 4 on which to place a document to be copied is disposed on the upper surface of the housing 2. Furthermore, an openable and closable document holder 6 is mounted on the upper surface of the housing 2 for covering the transparent plate 4 and a document placed on it (in FIG. 1, the document holder 6 is shown in a closed position at which it covers the transparent plate 4).

The inside of the housing 2 is divided into an upper space and a lower space by horizontal plates 8 and 10. A rotating drum 12 having a photosensitive material on its peripheral surface is rotatably mounted nearly centrally in the lower space. Around the rotating drum 12 to be rotated in the direction of an arrow 14 are disposed a charging zone 16, an exposing zone 18, a developing zone 20, a transfer zone 22, a peeling zone 24 and a cleaning zone 26 in this order as viewed in the rotating direction of the drum 12. A charging corona discharge device 28 is provided in the charging zone 16, and a suitable developing device 30 is provided in the developing zone 20. A transfer corona discharge device 32 is disposed in the transfer zone 22. A peeling corona discharge device 34 is disposed in the peeling zone 24. In the cleaning zone 26, there is provided a cleaning device 36 which as will be described in detail hereinafter includes a cleaning blade and a charge eliminating lamp.

A sheet material conveying device generally shown at 38 is disposed in the lower section of the housing 2. At one end (the right end in FIG. 1) of the sheet material conveying device 38, a cassette-type copying paper feed device 40 and a manual sheet feeding device 42 located above it are provided. The paper feed device 40 is comprised of a combination of a paper cassette receiving section 46 having a feed roller 44 provided therein and a copying paper cassette 50 to be loaded in the cassette receiving section 46 through an opening 48 formed in the right wall of the housing 2, and copying paper sheets are fed one by one from a layer 52 of copying paper cassette 50 by the action of the feed roller 44 (the paper feed device 40 will be described in greater detail hereinafter). The manual feeding device 42 includes a horizontal guide plate 56 projecting outwardly through an opening 54 formed in the right wall of the housing 2, a guide plate 58 located above the guide plate 56 and a pair of feed rollers 60 and 62 located downstream (left in FIG. 1) of these guide plates 56 and 58. When a suitable sheet material such as a copying paper sheet is positioned on the horizontal guide plate 56 and advanced to the nipping position of the pair of feed rollers 60 and 62, the feed rollers 60 and 62 nip the sheet material and feed it. The copying paper fed between the guide plates 64 and 66 from the paper feed device 40 or the sheet material fed between the guide plates 64 and 68 from the manual feed device 42 is conveyed to the transfer zone 22 and the peeling zone 24 between guide plates 74 and 76 by the action of a pair of conveying rollers 70 and 72.

Then, the sheet material is conveyed by the action of a suitable conveyor belt mechanism 78 to a fixing device 80 (which will be described in greater detail hereinafter). Thereafter, it is discharged onto a receiving tray 84 through an opening 82 formed in the left wall of the housing 2.

In the upper spaced above the horizontal plates 8 and 10 in the housing 2, there is provided an optical unit generally shown at 86 for scanning and exposing a document placed on the transparent plate 4 and projecting an image of the document onto the photosensitive material on the rotating drum 12 in the exposing zone 18. The optical unit 86 includes a document illuminating lamp 88 for illuminating the document on the transparent plate 4, and a first reflecting mirror 90, a second reflecting mirror 92, a third reflecting mirror 94, a lens assembly 96 and a fourth reflecting mirror 98 for projecting the light reflected from the document onto the photosensitive material. In the scanning and exposing process, the document illuminating lamp 88 and the first reflecting mirror 90 are moved from a scanning exposure start position shown by a solid line substantially horizontally to a required position (for example, a maximum scanning exposure end position shown by a two-dot chain line) at a required velocity V, and the second reflecting mirror 92 and the third reflecting mirror 94 are moved from a scanning exposure start position shown by a solid line to a required position (for example, a maximum scanning exposure end position shown by a two-dot chain line) at a velocity half of the aforesaid required velocity V (i.e., at $\frac{1}{2}$ V). At this time, the light reflected from the document illuminated by the document illuminating lamp 88 is successively reflected by the first reflecting mirror 90, the second reflecting mirror 92 and the third reflecting mirror 94, and reaches the lens assembly 96. Fron the lens assembly 96, the light is reflected by the fourth reflecting mirror 98 and reaches the photosensitive material in the exposure zone 18 through an opening 100 formed in the horizontal plate 8. When the scanning exposure is over, the document illuminating lamp 88, the first reflecting mirror 90, the second reflecting mirror 92 and the third reflecting mirror 94 are returned to the scanning exposure start position shown by the solid line.

In the copying apparatus described above, while the rotating drum 12 is rotated in the direction of arrow 14, the charging corona discharge device 28 charges the photosensitive material to a specified polarity substantially uniformly in the charging zone 16. Then, in the exposure zone 18, the optical unit 86 projects an image of the document to form a latent electrostatic image corresponding to the document on the charged photosensitive material. In the developing zone 20, the developing device 30 applies a toner to the latent electrostatic image on the photosensitive material to develop the latent electrostatic image to a toner image. Then, in the transfer zone 22, a sheet material such as a copying paper fed from the paper feed device 40 or the manual feeding device 42 is contacted with the photosensitive material, and by the action of the transfer corona discharge device 32, the toner image on the photosensitive material is transferred to the sheet material. Thereafter, in the peeling zone 24, the sheet material is peeled from the photosensitive material by the action of the peeling corona discharge device 34. The sheet material having the toner image transferred thereto is then conveyed to the fixing device 80 to fix the toner image, and then discharged into the receiving tray 84. In the meantime, the rotating drum continues to rotate, and in the cleaning zone 26, the toner and the static charge remaining on the photosensitive material after transfer are removed by the action of the cleaning device 36.

Shell-Type Supporting Structure

Figure 2:
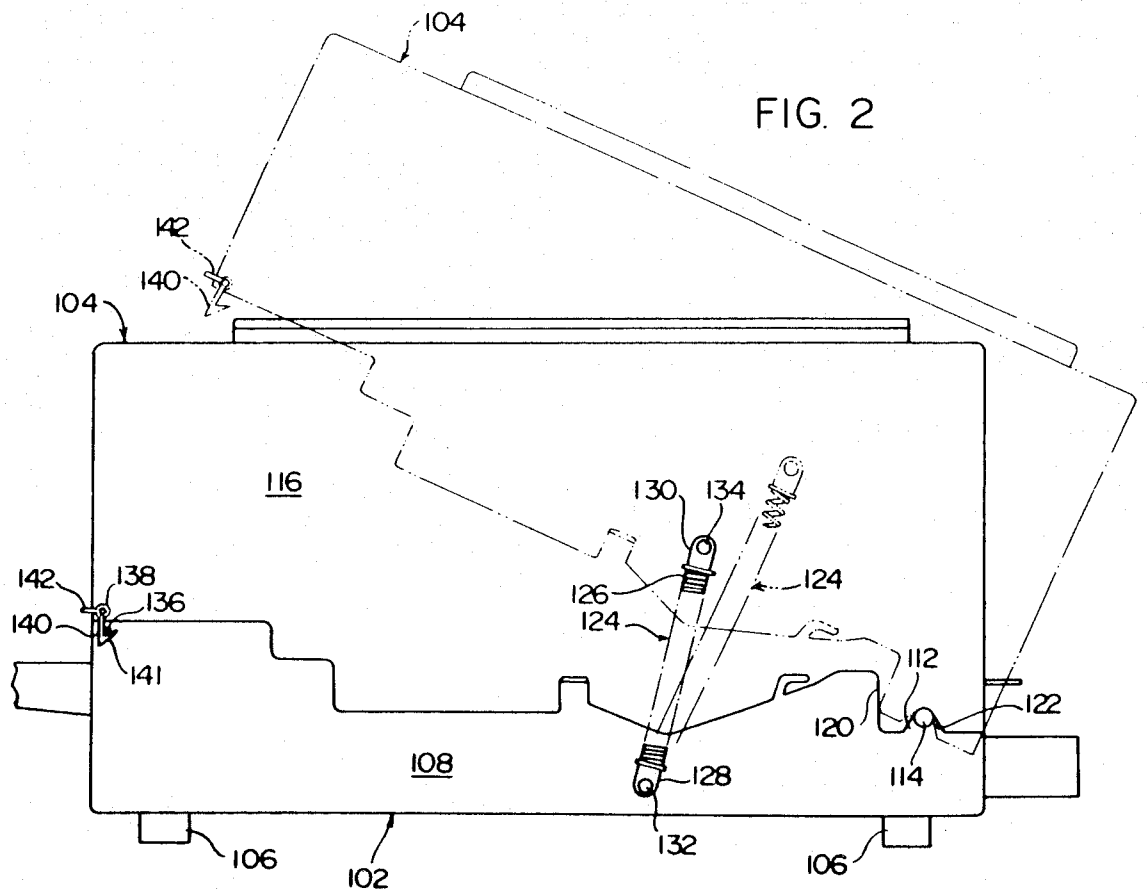
FIG. 2 is a simplified view showing a shell-type supporting structure in the copying apparatus shown in FIG. 1.

With reference to FIG. 2, the illustrated copying apparatus constructed in accordance with this invention is equipped with a so-called shell-type supporting structure constructed of a first supporting frame, or a lower supporting frame, 102 and a second supporting frame, or an upper supporting frame, 104 which are connected to each other for relative pivotal movement.

In the illustrated embodiment, a supporting leg 106 is formed on the lower surface of the lower supporting frame 102, and by positioning the supporting leg 106 on the upper surface of a supporting table (not shown) or the like, the lower supporting frame 102 is disposed in a required position. The lower supporting frame 102 has a vertical front base plate 108 and a vertical rear base plate 110 spaced from each other in the front-rear direction (a direction perpendicular in the sheet surface in FIG. 2) (FIG. 2 shows only the vertical front base plate 108, and for the vertical rear base plate 110, see FIGS. 3 and 7). To the right end portion of each of the vertical front base plate 108 and the vertical rear base plate 110 of the lower supporting frame 102, a supporting protruding portion 112 projecting upwardly is formed, and a pivotal supporting shaft 114 extending in the front-rear direction is mounted on the supporting protruding portion 112 (also see FIG. 3). The front end and the rear end of the supporting shaft 114 project somewhat forwardly and rearwardly of the supporting protruding portions 112 of the vertical front base plate 108 and the vertical rear base plate 110, respectively.

Figure 3:
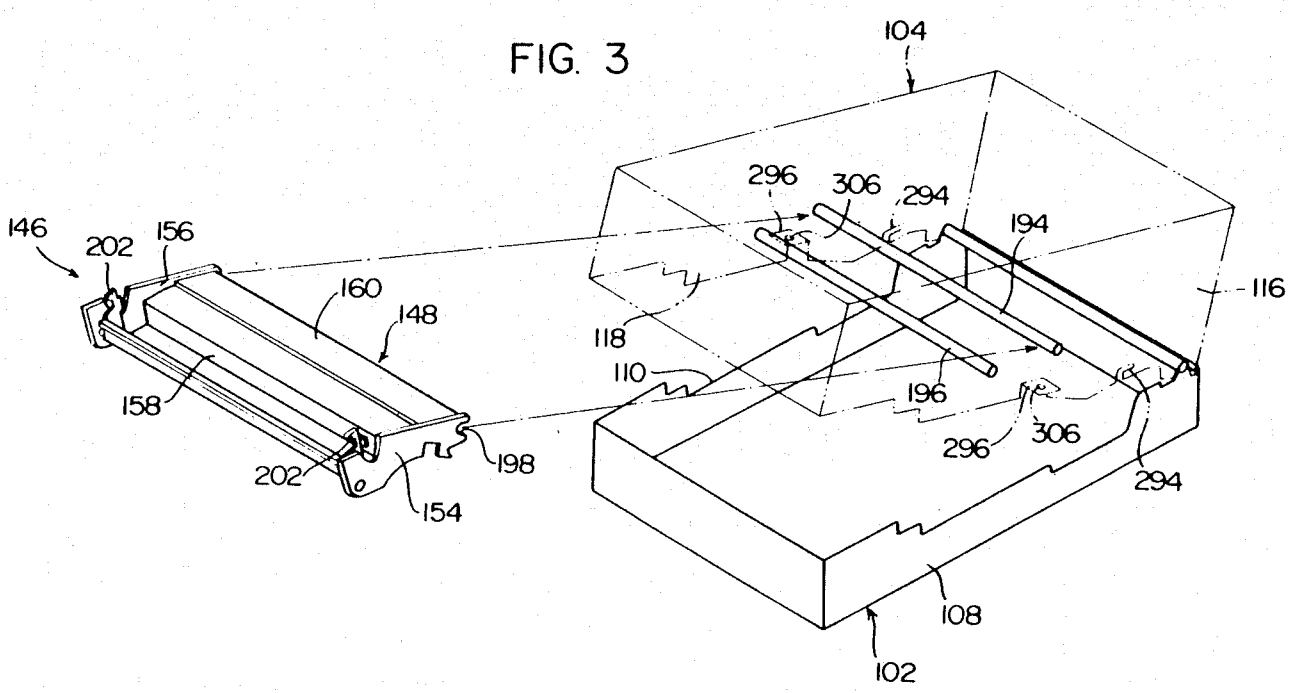
FIG. 3 is a simplified perspective view showing a shell-type supporting structure in the copying apparatus shown in FIG. 1 and a method of mounting a second unit on it.
Figure 7:
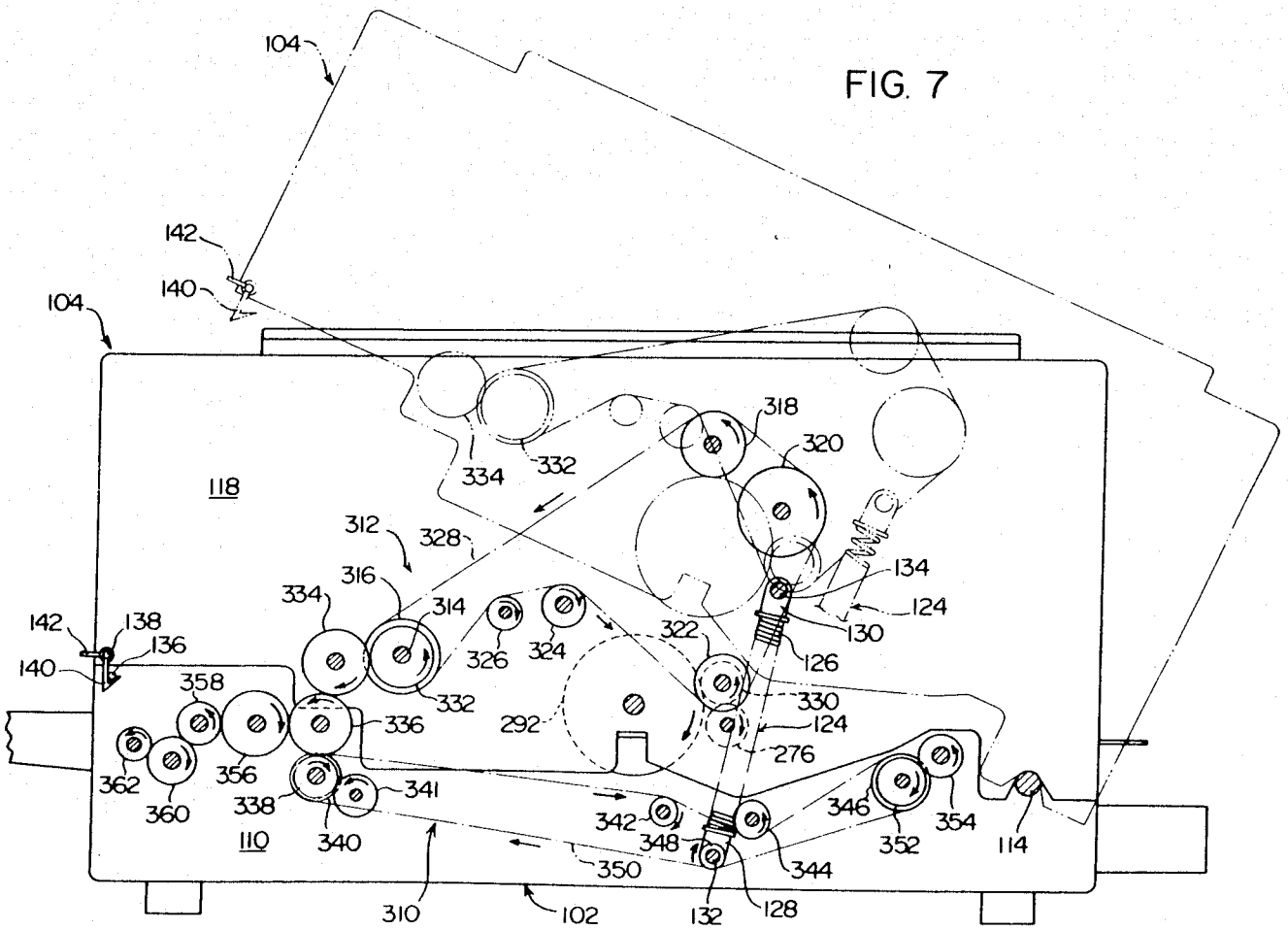
FIG. 7 is a simplified view showing a drive system in the copying apparatus shown in FIG. 1.

The upper supporting frame 104 also includes a vertical front base plate 116 and a vertical rear base plate 118 which are disposed in spaced-apart relationship in the front-rear direction (a direction perpendicular to the sheet surface in FIG. 2) (FIG. 2 shows only the vertical front base plate 116, and for the vertical rear base plate 118, see FIGS. 3 and 7). The distance in the front-rear direction between the vertical front base plate 116 and the vertical rear base plate 118 of the supporting frame 104 is slightly larger than the distance in the front-rear direction between the vertical front base plate 108 and the vertical rear base plate 110 of the lower supporting frame 102. The vertical front base plate 116 and the vertical rear base plate 118 of the upper supporting frame 104 are located slightly forwardly and rearwardly of the vertical front base plate 108 and the vertical rear base plate 110 of the lower supporting frame 102, respectively. A downwardly projecting protruding support portion 120 is formed in the right end portion of each of the vertical front base plate 116 and the vertical rear base plate 118 of the upper supporting frame 104, and a nearly semicircular cut 122 is formed at the lower edge of protruding support portion 120. The cuts 122 formed in the lower edges of the protruding support portions 120 are engaged with the opposite end portions of the supporting shaft 114 (i.e., its front end portion and rear end portion projecting beyond the vertical front base plate 108 and the vertical rear base plate 110 of the lower supporting frame 102 forwardly and rearwardly, respectively), and as a result, the supporting frame 104 is mounted on the lower supporting frame 102 for free pivotal movement about the support shaft 114. A restraining member (not shown) having a hole through which the supporting shaft 114 passes is fixed to each of the protruding support portion 120 of the supporting frame 104 thereby to prevent surely the upward movement of the protruding support portions 120.

Between the lower supporting frame 102 and the upper supporting frame 104 mounted on the lower supporting frame 102 for free pivotal movement about the supporting shaft 114, there is interposed a spring means 124 for elastically biasing the upper supporting frame 104 clockwise in FIG. 2 about the supporting shaft 114 with respect to the lower supporting frame 102. In the illustrated embodiment, the spring means 124 is comprised of a pair of compression coil springs 126 disposed on the front and rear surfaces of the lower supporting frame 102 and the upper supporting frame 104 (also see FIG. 7). Linking pieces 128 and 130 are fixed to the opposite ends of each of the compression coil springs 126. Between the linking pieces 128 and 134 is disposed a stretchable member (not shown) extending within the compression coil springs 126. On the other hand, the linking piece 128 of one compression coil spring 126 is privotally connected to a pin 132 set firmly in the front surface of the vertical front base plate 108 of the lower supporting frame 102, and the linking piece 130 is connected pivotally to a pin 134 set firmly in the vertical front base plate 116 of the upper supporting frame 104. The linking piece 128 of the other compression coil spring 126 is connected pivotally to a pin 132 set firmly in the rear surface of the vertical rear base plate 110 of the lower supporting frame 102, and the linking piece 130 is connected pivotally to a pin 134 firmly set in the rear surface of the vertical rear base plate 118 of the upper supporting frame 104 (FIG. 7). As stated above, the spring means 124 composed of a pair of compression springs elastically biases the supporting frame 104 clockwise in FIG. 2 about the supporting shaft 114 as a center. As can be easily understood, when the upper supporting frame 104 is pivoted clockwise in FIG. 2 about the supporting shaft 114 from the closed position shown by solid line in FIG. 2 by the elastic biasing action of the spring means 124, the elastic biasing action of the spring means 124 becomes gradually small as the upper supporting frame 104 pivots. When the upper supporting frame 104 is pivoted to the open position shown by a two-dot chain line in FIG. 2, the elastic biasing action of the spring means 124 to pivot the upper supporting frame 104 clockwise in FIG. 2 about the supporting shaft 114 is equilibrated with the moment acting to pivot the upper supporting frame 104 counterclockwise in FIG. 2 about the supporting shaft 114 due to the own weight of the upper supporting frame 104 and the various constituent elements mounted on it. As a result, the upper supporting frame 104 is held at the open position shown by a two-dot chain line in FIG. 2.

The lower supporting frame 102 and the upper supporting frame 104 also have provided therein a locking mechanism for locking the upper supporting frame 104 at the closed position shown in FIG. 2 against the elastic biasing action of the spring means 124. An engaging pin 136 is set firmly in the upper portion of the left end of the front surface of the vertical front base plate 108 of the lower supporting frame 102, and a supporting pin 138 is set firmly in the lower portion of the left end of the front surface of the vertical front base plate 116 of the upper supporting frame 104. A hook 140 to be engaged with the engaging pin 136 is mounted on the supporting pin 138. The hook 140 is mounted on the supporting pin 138 so that it can freely pivot clockwise in FIG. 2 from the angular position shown in the drawing, and is elastically biased counterclockwise in FIG. 2 and elastically held at the angular position shown in the drawing by spring means (not shown). The lower end of the hook 140 is inclined upwardly to the right in the drawing. Furthermore, an operating piece 142 protruding outwardly beyond the left edge of the upper supporting frame 104 is provided in the hook 140. In the illustrated embodiment, an engaging pin 136 and a hook 140 are likewise provided in the top left end of the rear surface of the vertical rear base plate 110 of the lower supporting frame 102 and the left end bottom of the rear surface of the vertical rear base plate 118 of the supporting frame 104 (see FIG. 7). If desired, the operating piece 142 of the hook 140 provided on the front surface may be linked with the operating piece 142 of the hook 140 provided on the rear surface by a suitable member extending in the front-rear direction (i.e., a direction perpendicular to the sheet surface in FIG. 2) to interlock the two hooks 140.

When the upper supporting frame 104 is pivoted counterclockwise about the supporting shaft 114 from the open position shown by the two-dot chain line in FIG. 2 to a point near the closed position shown by the solid line in FIG. 2 against the elastic biasing action of the spring member 124, the inclined lower edge 141 of the hook 140 abuts against the engaging pin 136, thereby to pivot the hook 140 clockwise about the supporting pin 138 as a center. When the upper supporting frame 104 is pivoted to the closed position shown by the solid line in FIG. 2, the inlined lower edge of the hook 140 goes past the engaging pin 136, and therefore, the hook 140 is returned to the angular position shown in the drawing by the elastic biasing action of the spring means (not shown) and engaged with the engaging pin 136. Thus, the supporting frame 104 is surely locked at the closed position shown by the solid line in FIG. 2 against the elastic biasing action of the spring means 124. On the other hand, when the operating piece 142 of the hook 140 is manually operated to pivot the hook 140 clockwise about the supporting pin 138 as a center and to disengage it from the engaging pin 136, the upper supporting frame 104 is pivoted about the supporting shaft 114 as a center to the open position shown by the two-dot chain line in FIG. 2 by the elastic biasing action of the spring means 124.

With reference to FIG. 1 taken in conjunction with FIG. 2, in the illustrated copying apparatus, the constituent elements which are located below a one-dot chain line 144 in FIG. 1 are mounted on the lower supporting frame 102, and the constituent elements located above the one-dot chain line 144 in FIG. 1 are mounted on the upper supporting frame 104. Accordingly, as can be easily understood with reference to FIG. 1, when the upper supporting frame 102 is pivoted from the closed position shown by the solid line in FIG. 2 to the open position shown by the two-dot chain line in FIG. 2, a greater portion of the sheet material conveying passage is opened. Hence, any sheet material which has jammed up in this portion can be easily taken out (it will be easily understood from FIG. 1 that by only bringing the upper supporting frame 104 to the open position shown by the two-dot chain line in FIG. 2, the sheet material conveying passage in the fixing device 80 is not opened, and to completely open the sheet material conveying passage, an additional operation is required; this will be described in detail hereinafter).

Additionally, a front cover and a rear cover are also mounted on the lower supporting frame 102 and the upper supporting frame 104 (if further required, a right end cover for covering the right end surface thereof and a left end cover for covering the left end surface thereof may also be mounted). These covers are suitably divided into a lower section and an upper section. The lower sections are mounted on the lower supporting frame 102, and the upper sections are mounted on the upper supporting frame 104 and pivoted between the closed position and the open position together with the upper supporting frame 104.

Provision of the Rotating Drum and Other Members as Units

As will be easily understood by referring to FIGS. 1 and 2, in the illustrated copying apparatus, the rotating drum 12 and the cleaning device 36, the charging corona discharge device 28 and the developing device 30 disposed around the rotating drum 12 are mounted on the upper supporting frame 104. In order to perform mounting and detaching of these constituent elements very easily and rapidly for the purposes of repair, inspectron, cleaning, replacement, etc., the rotating drum 12 and the developing device 30 are constructed as a first unit, the cleaning device 36 and the charging corona discharge device 28 are constructed as a second unit, and the first and second units are detachably mounted on the upper supporting frame 104.

Figure 4:
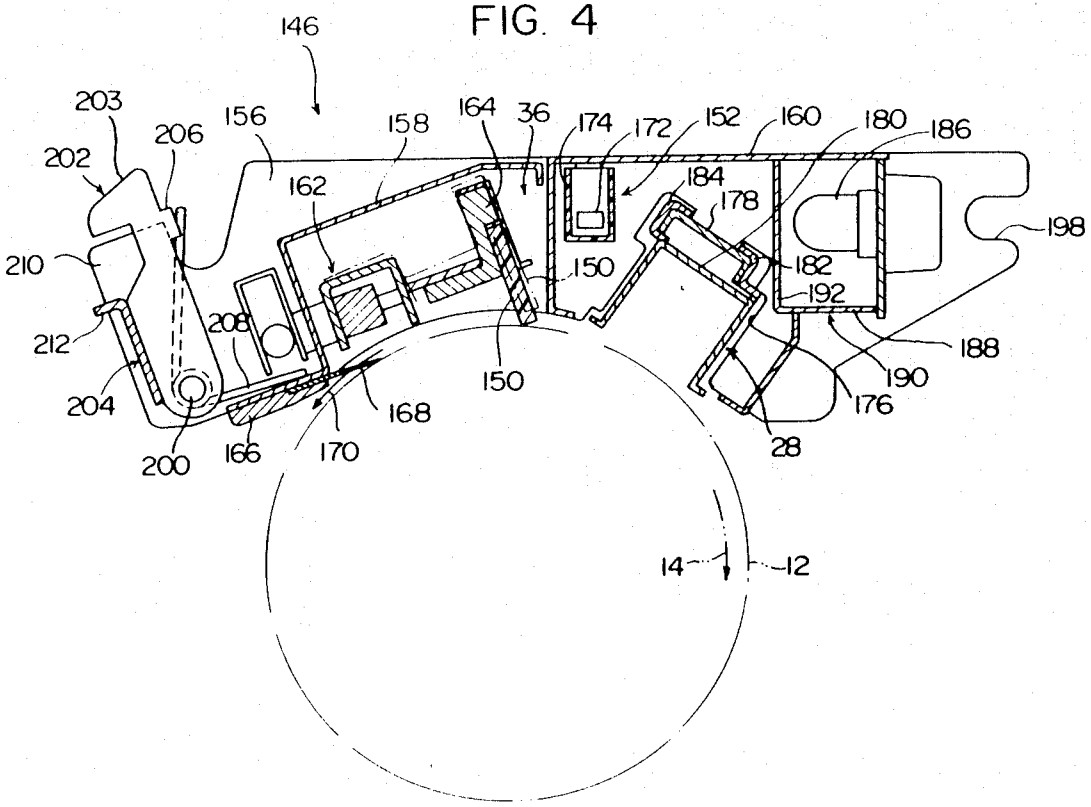
FIG. 4 is a partial sectional view showing a second unit in the copying apparatus shown in FIG. 1.

For convenience of description, the second unit containing the cleaning device 36 and the charging corona discharge device 28 will first be described. With reference to FIGS. 3 and 4, the second unit shown generally at 146 has a second unit frame 148, and the cleaning device 36 including a cleaning blade 150 and a charge eliminating lamp 152 and the charging corona discharge device 28 are mounted on the second unit frame 148. The second unit frame 148 has a front wall 154 and a rear wall 156 spaced from each other in the front-rear direction, and side members 158 and 160 are fixed to, and between, the front wall 154 and the rear wall 156. With reference mainly to FIG. 4, a blade supporting mechanism 162 is mounted on the side member 158. A blade holding member 164 is provided at one end portion of the blade supporting mechanism 162. To the blade holding member 164 is fixed the base portion of a cleaning blade 150 made of a suitable flexible member extending in a direction perpendicular to the sheet surface in FIG. 4 over substantially the entire width of the photosensitive material on the rotating drum 12. The blade supporting mechanism 162 itself includes an electromagnetic solenoid (not shown) for controlling a half-rotating spring clutch means (not shown) and a suitable spring means (not shown). When the electromagnetic solenoid is energized (or deenergized), the cleaning blade 150 is held at an operating position shown by a solid line in FIG. 4 (at which position the free end of the cleaning blade 150 is pressed against the photosensitive material on the rotating drum 12) by the elastic biasing action of the spring means. When the electromagnetic solinoid is deenergized (or energized), the cleaning blade 150 is held at a non-operating position shown by a two-dot chain line in FIG. 4 (at which the free end of the cleaning blade 150 is moved away from the photosensitive material on the rotating drum 12). The construction of the blade supporting mechanism 162 itself does not constitute a novel characteristic in the illustrated copying apparatus improved in accordance with this invention, and may be substantially the same as the construction disclosed in the specification and drawings of Japanese Patent Application No. 191276/1981 filed Nov. 27, 1981 (entitled "CLEANING DEVICE OF ELECTROSTATIC COPYING APPARATUS"). Accordingly, a description of the construction of the blade supporting mechanism 162 itself is omitted in the present specification.

In the illustrated embodiment, in relation to the cleaning blade 150, a supporting member 166 is fixed to the lower surface of the left end portion of the side member 158, and the base portion of a shielding material 168 formed of a flexible material is fixed to the supporting member 166. The free end of the shielding member 168 projecting from the base portion fixed to the supporting member 166 contacts the photosensitive material on the rotating drum 12 relatively weakly to prevent the toner removed from the photosensitive material by the action of the cleaning blade 150 from being dissipated in the direction shown by an arrow 170.

The charge eliminating lamp 152 extending in a direction perpendicular to the sheet surface in FIG. 4 over substantially the entire width of the photosensitive material on the rotating drum 12 has a light emitting source 172 and a transparent or semi-transparent case 174, and is fixed to the under surface of the upper surface portion of the side member 160. The charge eliminating lamp 152 illuminates the photosensitive material in a zone immediately downstream of the cleaning blade 150 as viewed in the rotating direction shown by arrow 14 of the rotating drum 12 and thereby removes a residual charge on the photosensitive material.

Downwardly directed openings 176 are formed respectively in the front wall 154 and the rear wall 156 of the second unit frame 148 immediately downstream of the charge eliminating lamp 152 viewed in the rotating direction 14 of the rotating drum 12. A supporting rail 178 extends across the front wall 154 and the rear wall 156 and is fixed to the upper end edge portions of these openings 176. On the other hand, guide rails 182 and 184 are fixed to the opposite end portions of the upper wall of a shield case 180 for the charging corona discharge device 28. The charging corona discharge device 28 are mounted detachably at a required position by engaging the guide rails 182 and 184 with the supporting rail 178 and moving them in the direction perpendicular to the sheet surface in FIG. 4.

In the illustrated embodiment, charge eliminating lamps 190 (only one is shown in FIG. 4) having a light emitting source 186 and a case 188 are fixed respectively to the front end portion and the rear end portion of the under surface of the upper surface portion of the side member 160. The light emitting source 186 of the charge eliminating lamp 190 is selectively energized when the width of a sheet material conveyed to the transfer zone 22 is smaller than the width of the photosensitive material on the rotating drum 12 and therefore it is desired to form a latent electrostatic image only on a part of the photosensitive member in the widthwise direction. Upon energization, the light emitting source 186 illuminates both side portions of the photosensitive material through an opening 192 formed in the case 188 and selectively removes a charge from both sides of the photosensitive material which is charged substantially uniformly by the charging corona discharge device 28 over substantially the entire width of the photosensitive material.

Figure 5:
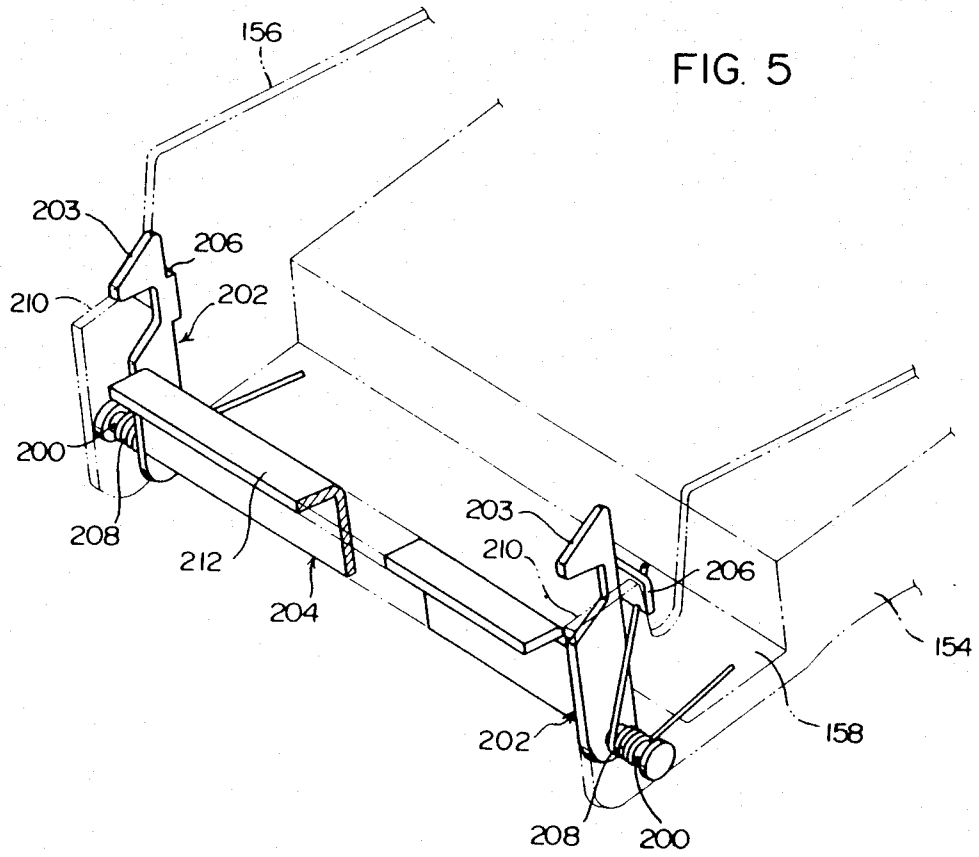
FIG. 5 is a partial perspective view showing a part of the second unit in the copying apparatus shown in FIG. 1.

The method of mounting the second unit 146 described above on the upper supporting frame 104 will be described. With reference mainly to FIG. 3, a pair of supporting rods 194 and 196 extending in the front-rear direction at predetermined intervals in the lateral direction are mounted between the vertical front base plate 116 and the vertical rear base plate 118 of the supper supporting frame 104. On the other hand, a slot 198 is formed at one edge portion of each of the front wall 154 and the rear wall 156 of the second unit frame 148, (i.e. in the right edge portion in FIG. 4). As most clearly shown in FIG. 5, at the other end portion (i.e., the left edge portion in FIG. 4) of the second unit frame 148, engaging hooks 202 are pivotally mounted by supporting pins 200 set firmly in the rear surface of the front wall 154 and the front surface of the rear wall 156 respectively. The front engaging hook 202 and the rear engaging hook 202 are connected to each other by a nearly L-shaped linking member 204 extending therebetween. Projecting pieces 206 projecting forwardly and rearwardly are formed respectively on the upper portions of the front engaging hook 202 and the rear engaging hook 202. To each of the support pins 200 is mounted a spring member 208 constructed of a torsion coil spring. One end of the spring means 208 abuts against the upper surface of the left end portion of the side member 158 fixed to, and between, the front wall 154 and the rear wall 156 of the second unit frame 148, and its other end abuts against the projecting piece 206. The spring member 208 elastically biases the engaging hooks 202 counterclockwise in FIG. 4. When the engaging hooks 202 are held at their operating position shown in FIGS. 3 to 5, the projecting pieces 206 of the engaging hooks 202 abut against the upwardly extending protruding portions 210 formed in the other end portions (the left edge portions in FIG. 4) of the front wall 154 and the rear wall 156 of the second unit frame 148. As a result, the engaging hooks 202 are prevented from pivoting further clockwise in FIG. 4. It will be clear therefore that the engaging hooks 202 are elastically held at the operating position shown in FIGS. 3 to 5 by the spring means 208. The upper end edge 203 of each engaging hook 202 is inclined downwardly to the left in FIG. 4.

With reference mainly to FIG. 3, in mounting the second unit 146 on the upper supporting frame 104, the second unit 146 is inserted between the vertical front base plate 116 and the vertical rear base plate 118 of the upper supporting frame 104 from below the upper supporting frame 104 positioned at the open position shown by the two-dot chain line in FIG. 3, and the slots 198 formed in the front wall 154 and the rear wall 156 of the second unit 146 both at one edge portion are engaged with the supporting rod 194. Then, the second unit 146 is pivoted clockwise about the supporting rod 194 as a center as viewed from ahead of the unit 146 thereby to raise the other edge portion of the second unit 146. As a result, the inclined upper end edge 203 of each of the engaging hooks 202 abuts against, and interferes with, the supporting rod 196, whereby the engaging hooks 202 are pivoted clockwise as viewed from ahead of the engaging hooks 202 against the elastic biasing action of the spring means 208. When the rising of the other edge portion of the second unit 146 is continued, the inclined upper end edge 203 of each engaging hook 202 goes past the supporting rod 196. As a result, the engaging hooks 202 are returned to the operating position shown in FIGS. 3 to 5 by the elastic biasing action of the spring means 208 and engaged with the supporting rod 196. Thus, the second unit 146 is mounted at a required position by the supporting rods 194 and 196. In detaching the second unit 146 from the upper supporting frame 104, the protruding portion 212 of the linking member 204 connecting the front engaging hook 202 to the rear engaging hook 202 is manually operated to pivot the engaging hooks 202 clockwise as viewed from ahead of the hooks 202 against the elastic biasing action of the spring means 208 and thus detach them from the supporting rod 196. Then, the second unit 146 is pivoted counterclockwise as viewed from ahead of the second unit 146 about the supporting rod as a center to lower the other edge of the second unit 146. Then, the supporting rod 194 is disengaged from the slots 198 formed in the front wall 154 and the rear wall 156 of the second unit 146.

Figure 6:
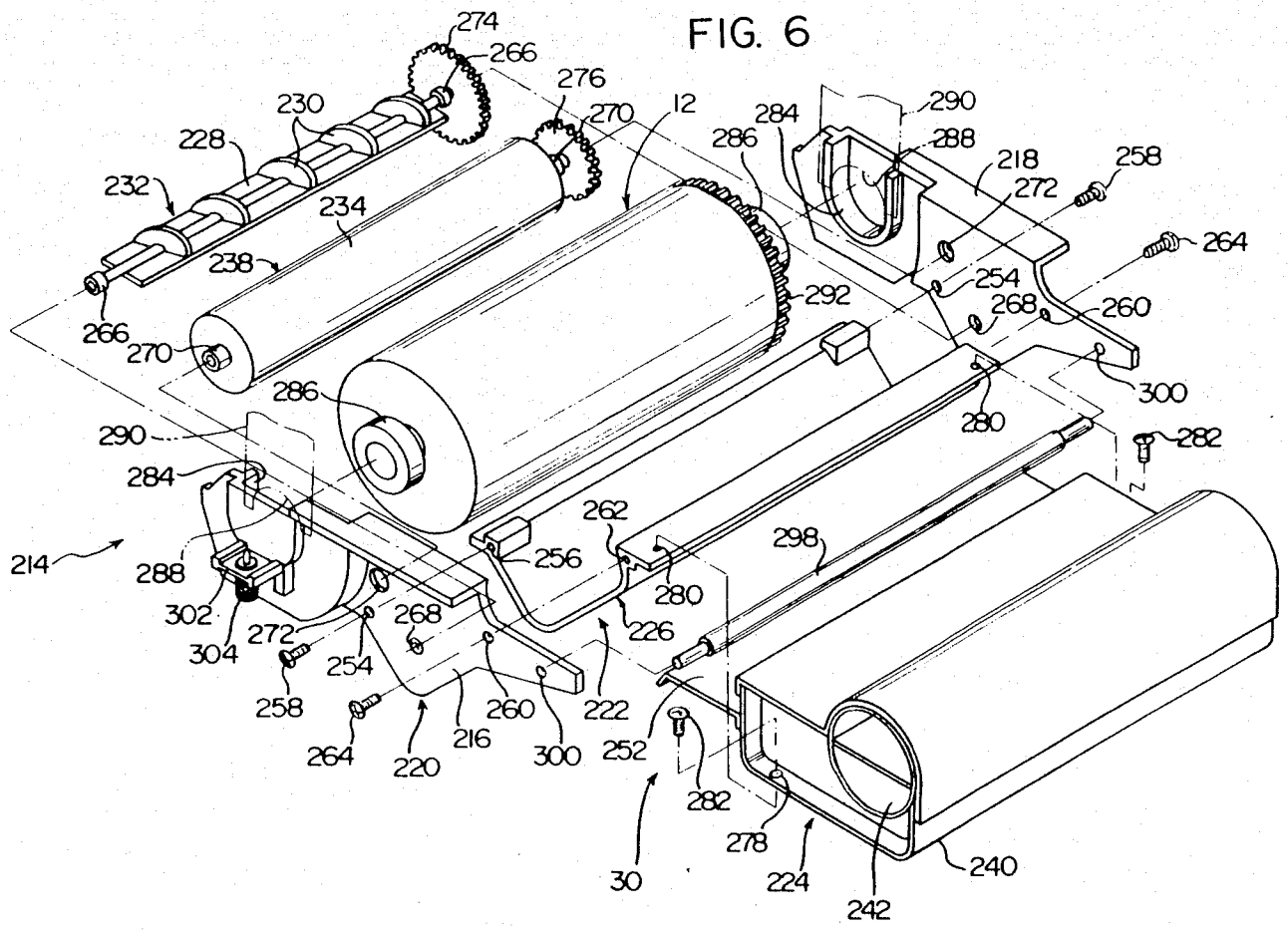
FIG. 6 is an exploded perspective view showing a first unit in the copying apparatus shown in FIG. 1.

Now, the first unit including the rotating drum 12 and the developing device 30 will be described. With reference to FIG. 6, the first unit shown generally at 214 includes a first unit frame 220 having a front wall 216 and a rear wall 218 spaced from each other in the front-rear direction, and the rotating drum 12 and the developing device 30 are mounted on the first unit frame 220.

With reference to FIG. 1 taken in conjunction with FIG. 6, the construction of the developing device 30 which may be of a known form will be generally described. The illustrated developing device 30 is constructed of a developing mechanism 222 and a toner supply mechanism 224. The developing mechanism 222 has a developer container 226 for accommodating a developer composed of a carrier and a toner, an agitating means 232 including an agitating plate 228 and a plurality of agitating blades 230 disposed on both surfaces of the agitating plate 228, and a magnetic brush means 238 comprised of a cylindrical sleeve 234 and a roll-like stationary permanent magnet 236 disposed within the cylindrical sleeve 234. The agitating means 232 is rotated counterclockwise in FIG. 1 to agitate the developer in the developer container 226 and to charge the toner triboelectorically. The sleeve 234 of the magnetic brush means 238 is rotated clockwise in FIG. 1. The sleeve 234 holds the developer onto its surface by the magnetic attracting force of the permanent magnet 236 disposed therein, applies the developer to the photosensitive material on the rotating drum 12 and thus selectively causes the toner to adhere to the photosensitive material according to a latent electrostatic image formed on the photosensitive material. The toner supply mechanism 224 is comprised of a toner container 240 for holding a toner therein, a hollow cylindrical toner cartridge 242 to be mounted above one end portion of the toner container 240, a toner conveying means 244 disposed in the toner container 240, and a toner supply means 246. The toner cartridge 242 has an openable discharge outlet 248 to be formed at a predetermined angular position of its perpheral side wall. After opening the discharge outlet 248, the cartridge 242 is inserted into the toner container 240 through a circular opening formed in the front surface of the toner container 240 while its discharge outlet 248 is positioned upwardly. Thereafter, the cartridge 242 is turned to assume the state shown in FIG. 1 in which the discharge outlet 248 is located downwardly. Thus, the toner accommodated in the toner cartridge 242 is discharged downwardly through the discharge outlet 248 and supplied to the toner container 240. The toner conveying means 244 of a suitable form located below the discharge outlet 248 of the toner cartridge 242 is driven by a motor (not shown) exclusively used for toner supplying and mounted on the rear surface of the toner container 240, and conveys the toner discharged from the discharge opening 248 of the toner cartridge 242 to the left in FIG. 1. The toner supply means 246 of a suitable form disposed in the right end lower portion of the toner container 240 is driven by the aforesaid motor exclusively used for toner supplying (not shown), and supplies the toner conveyed by the toner conveying means 244 to the developer container 226 of the developing mechanism 222 through an opening 250 formed in the left end of the toner container 240. To the left end wall of the toner container 240 is fixed a cover 252 extending therefrom to the left and covering the upper portion of the developing mechanism 222. The developing device 30 itself composed of the developing mechanism 222 and the toner supply mechanism 224 does not constitute a novel characteristic of the copying apparatus constructed in accordance with this invention, and is merely one example of a developing device that can be used. A further detailed description of the developing device 30 will, therefore, be omitted in this specification.

With reference mainly to FIG. 6, the method of mounting the developing device 30 on the first unit frame 220 will be described. The developer container 226 of the developing mechanism 222 is fixed to, and between, the front wall 216 and the rear wall 218 of the first unit frame 220 by screwing a setscrew 258 in a screw hole 256 formed in the left edge portion of the developer container 226 through holes 254 formed in the front wall 216 and the rear wall 218 of the first unit frame 220 and screwing a setscrew 264 in a screw hole 262 formed in the right end portion of the developer container 226 through holes 260 formed in the front wall 216 and the rear wall 218 of the first unit frame 220. The agitating means 232 of the developing mechanism 222 has shaft supporting members 266 having a circular peripheral surface and mounted on its front end portion and rear end portion, and is mounted rotatably between the front wall 216 and the rear wall 218 of the first unit frame 220 by mounting the shaft supporting members 266 in holes 268 formed in the front wall 216 and the rear wall 218 of the first unit frame 220. Likewise, the magnetic brush means 238 has shaft supporting members 270 having a circular peripheral surface and mounted on its front end portion and rear end portion, and is rotatably mounted between the front wall 216 and the rear wall 218 of the first unit frame 220 by fitting the shaft supporting member 270 in holes 272 formed in the front wall 216 and the rear wall 218 of the first unit frame 220. As clearly shown in FIG. 6, gears 274 and 276 are fixed respectively to the rear end of the agitating means 232 and the rear end of the magnetic brush means 238. When the agitating means 232 and the magnetic brush means 238 are mounted at predetermined positions, these gears 274 and 276 are brought into engagement with each other. As will be stated hereinafter, when the first unit 214 is mounted on the upper supporting frame 104 in the required manner, these gears 274 and 276 are drivingly connected to a drive source such as an electric motor constituting a main drive source for the copying apparatus through a suitable power transmission system. The toner supply mechanism 224 as an integral unit is fixed to the developer container 226 by screwing a setscrew 282 in a screw hole 280 formed in a protruding portion present in the right edge portion of the developer container 226 through holes 278 formed in protruding portions present in the front surface and rear surface of the toner container 240.

The method of mounting the rotating drum 12 on the first unit frame 220 will now be described. As clearly shown in FIG. 6, upwardly opened semi-circular receiving sections 284 are formed in the rear surface of the front wall 216 and the front surface of the rear wall 218 in the first unit frame 220. On the other hand, shaft supporting members 286 having a circular peripheral surface are mounted on the front end and rear end of the rotating drum 12 respectively. The rotating drum 12 is mounted rotatably between the front wall 216 and the rear wall 218 of the first unit 220 by inserting the shaft supporting members 286 into the receiving sections 284 from above. On the other hand, as will be stated hereinbelow, restraining pieces 290 (FIG. 6 shows only a lower restraining piece by a two-dot chain line) conveniently having semi-circular cuts 288 at the lower ends thereof are fixed to the rear surface of the vertical front base plate 116 and the front surface of the vertical rear base plate 118 in the upper supporting frame 104 on which the first unit 214 is to be mounted. When the first unit 214 is mounted on the upper supporting frame 104 in the required manner, the cuts 288 of the restraining pieces 290 abut, immediately inwardly of the receiving sections 284, against the upper half surfaces of the shaft supporting members 286 mounted on the opposite ends of the rotating drum 12. As a result, the shaft supporting members 286 are surely prevented from moving upwardly from the receiving sections 284. If desired, the restraining pieces 290 may also be detachably mounted on the first unit frame 220. As shown in FIG. 6, a gear 292 is fixed to the rear end portion of the rotating drum 12. The gear 292 is drivingly connected through a suitable power transmission system to a drive source such as an electric motor constituting a main drive source for the copying apparatus when the first unit 214 is mounted on the upper supporting frame 104 in the required manner.

Now, with reference to FIG. 3 together with FIG. 6, the method of mounting the first unit 214 described above on the upper supporting frame 104 will be described. As illustrated in FIG. 3, slots 294 extending upwardly from the lower edge thereof and then extending to the right are formed respectively in the vertical front base plate 116 and the vertical rear base plate 118 of the upper supporting frame 104. Furthermore, at positions spaced a predetermined distance to the left from the slots 294, a forwardly extending projecting piece 296 and a rearwardly extending projecting piece 296 are formed in the vertical front base plate 116 and the vertical rear base plate 118 of the upper supporting frame 104. On the other hand, as shown in FIG. 6, an engaging rod 298 is mounted on the right edge portion of the front wall 216 and the right edge portion of the rear wall 218 in the first unit frame 220. The engaging rod 298 is mounted in the required manner on the first unit frame 220 by inserting its opposite end portions into holes 300 formed respectively in the right edge portion of the front wall 216 and the right edge portion of the rear wall 218 of the first unit frame 220. Thus, the opposite end portions of the engaging rod 298 mounted on the first unit frame 220 project forwardly and rearwardly beyond the front wall 216 and the rear wall 218, respectively. Furthermore, protrusions 302 extending forwardly and rear-wardly are formed respectively in the left edge portion of the front wall 216 and the left edge portion of the rear wall 218 of the first unit frame 220.

In mounting the first unit 214 on the upper supporting frame 104, the opposite end portions of the engaging rod 298 at one edge portion of the first unit 214, i.e., its opposite end portions projecting forwardly and rearwardly beyond the front wall 216 and the rear wall 218, are engaged with the slots 294 formed in the vertical front base plate 116 and the vertical rear base plate 118 of the upper supporting frame 104. Then, the first unit 214 is pivoted clockwise as seen from ahead of it about the engaging rod 298 in the slots 294 as a center, thereby to raise the other end edge portion of the first unit 214. As a result, the protrusions 302 formed in the other edge portion of the front wall 216 and the other edge portion of the rear wall 218 in the first unit frame 220 are positioned immediately below the protruding pieces 296 formed in the vertical front base plate 116 and the vertical rear base plate 118 of the upper supporting frame 104. Thereafter, a setscrew 304 projecting upwardly through each protrusion 302 is manipulated and screwed in a screw hole 306 formed in each protruding piece 296. Thus, the first unit 214 is mounted in the required manner between the vertical front base plate 116 and the vertical rear base plate 118 of the upper supporting frame 104. The first unit 214 can be detached from the upper supporting frame 104 by manipulating the setscrew 304 to remove it from the screw hole 306 in the protruding piece 296, thus releasing the screwing of the protruding piece 296 and the protrusion 302, and then detaching the engaging rod 298 from the slots 294.

As can be easily understood from FIG. 3,4 or 1, in the illustrated embodiment, the second unit 146 is located above the first unit 214. Accordingly, when the first unit 214 and the second unit 146 are to be mounted on the upper supporting frame 104, it is necessary first to mount the second unit 146 and then the first unit 214. To detach them from the upper supporting frame 104, it is necessary to detach the first unit 214 first and then detach the second unit 146.

Drive system

Now, referring to FIGS. 1 and 7, the drive system in the illustrated copying apparatus will be described at some length.

In the illustrated copying apparatus, a drive source 308 (FIG. 1), such as an electric motor, constituting a main drive source is mounted on the upper supporting frame 104. In the lower supporting frame 102, there is provided a first power transmission system shown generally at 310 which, as will be described in detail hereinafter, is drivingly connected to the drive source 308 when the upper supporting frame 104 is held at its closed position. In the upper supporting frame 104 is provided a second power transmission system shown generally at 312 which is drivingly connected to the drive source 308 irrespective of the position of the upper supporting frame 104.

For convenience of description, the second power transmission system 312 provided on the upper supporting frame 104 will first be described. With reference mainly to FIG. 7, an output shaft 314 of the drive source 308 projects rearwardly through the vertical rear base plate 118 of the upper supporting frame 104, and a sprocket wheel 316 is fixed to the projecting end portion of the output shaft 314. The second power transmission system 312 further includes sprocket wheels 318, 320, 322, 324 and 326. An endless chain 328 is wrapped about the sprocket wheels 316, 318, 320, 322, 324 and 326. Accordingly, when the drive source 308 is energized and its output shaft 314 is rotated in the direction shown by an arrow, the sprocket wheels 316, 318, 320, 322, 324 and 326 are rotated in the directions shown by arrows. The sprocket wheel 318 is connected through a clutch mechanism (not shown) for scanning movement to a known optical unit driving mechanism (not shown) for driving the document illuminating lamps 88, the first reflecting mirror 90, the second reflecting mirror 92 and the third reflecting mirror 94 of the optical unit 86. The sprocket wheel 320 is connected to the optical unit driving mechanism (not shown) through a clutch mechanism (not shown) for return movement. When the clutch mechanism for scanning movement is actuated, the document illuminating lamp 88, the first reflecting mirror 90, the second reflecting mirror 92 and the third reflecting mirror 94 of the optical unit 86 are moved for scanning to the right in FIG. 1. When the clutch mechanism for return movement is actuated, the document illuminating lamp 88, the first reflecting mirror 90, the second reflecting mirror 92 and the third reflecting mirror 94 of the optical unit 86 are caused to make a returning movement to the left in FIG. 1. A gear 330 is connected to the sprocket wheel 322 so that it can rotate as a unit with the sprocket wheel 322. The gear 330 is in mesh with a gear 276 (see FIG. 6 also) fixed to the magnetic brush means 238 of the developing device 30 and a gear 292 (see FIG. 6 also) fixed to the rotating drum 12. The sprocket wheel 324 is connected to a half-rotating spring clutch means (not shown) utilized to hold the cleaning blade 150 (FIG. 4) at its operating position or a non-operating position. (For details about the half-rotating spring clutch means, see the specification and drawings of the above-cited Japanese Patent Application No.

191276/1981). The sprocket wheel 326 is an idle sprocket wheel for maintaining the endless chain 328 taut.

In addition to the spricket wheel 316, an interlocking output gear 332 is further mounted on the output shaft 314 of the drive source 308. An interlocking linking gear 334 in mesh with the interlocking output gear 332 is also mounted on the vertical rear base plate 118 of the upper supporting frame 104. On the other hand, an interlocking input gear 336 is mounted on the vertical rear base plate 110 of the lower supporting frame 102. When the upper supporting frame 104 is at its open position shown by a two-dot chain line in FIG. 7, the interlocking linking gear 334 is out of engagement with the interlocking input gear 336. When the upper supporting frame 104 is held at its closed position shown by a solid line in FIG. 7, the interlocking linking gear 334 comes into engagement with the interlocking input gear 336. As a result, the interlocking input gear 336 is drivingly connected to the drive source 308 through the interlocking output gear 332 and the interlocking linking gear 334 (the interlocking output gear 332, the interlocking linking gear 334 and the interlocking input gear 336 will be described in more detail hereinafter).

The first power transmission system 310 provided in the lower supporting frame 102 includes a gear 338 which is rotatably mounted on the vertical rear base plate 110 of the lower supporting frame 102 and is in mesh with the interlocking input gear 336. A gear 341 is in mesh with the gear 338. The gear 314 is connected to the driven belt wheel (the belt wheel in the left of FIG. 1) of the conveying blet mechanism 78 (FIG. 1) so that it rotates as a unit with the belt wheel. Furthermore, a sprocket wheel 340 is connected to the gear 338 so that it can rotate as a unit with the gear 338. The first power transmission system 310 further includes sprocket wheels 342, 344, 346 and 348, and an endless chain 350 is wrapped about the sprocket wheels 340, 342, 344, 346 and 348. The sprocket wheels 342 and 348 are idle sprocket wheels for maintaining the endless chain 350 taut. The sprocket wheel 344 is connected to the conveying rollers70 and 72 (FIG. 1) so that it can rotate as a unit with the roller 70. The sprocket wheel 346 is connected to the feed roller 44 (FIG. 1) of the copying paper feed device 40 through a clutch means (this clutch means will be described in more detail hereinafter). The sprocket wheel 346 is also connected to a gear 352 so that it can rotate as a unit with the gear 352. A gear 354 is in mesh with the gear 352. The gear 354 is connected to the feed roller 62 so that it can rotate as a unit with the roller 62. The first power transmission system 310 further includes a gear train composed of gears 356, 358, 360 and 362. These gears 356, 358, 360 and 362 will be described in detail hereinafter with regard to the fixing device 80. Let us suppose that the upper supporting frame 104 is at its closed position shown by the solid line in FIG. 7 and therefore the interlocking input gear 336 is drivingly connected to the drive source 308 through the interlocking output gear 332 and the interlocking linking gear 334. When in this state the drive source 308 is energized and rotated in the direction of the arrow, the various constituent elements in the first power transmission system 310 are rotated in the directions shown by arrows.

Interlocking mechanism

As stated above with reference to FIG. 7, when the upper supporting frame 104 is brought from its open position shown by the two-dot chain line to its closed position shown by the solid line, the interlocking linking gear 334 mounted on the upper supporting frame 104 comes into engagement with the interlocking input gear 336 mounted on the lower supporting frame 102, and therefore, the output shaft 314 of the drive source 308 is drivingly connected to the interlocking input gear 336 through the interlocking output gear 332 and the interlocking linking gear 334, and therefore drivingly connected to the first power transmission system 310 which is provided in the lower supporting frame 102 and drivingly connected to the interlocking input gear 336. It will be easily understood from FIG. 7 that the moving track of the interlocking linking gear 334 during the movement of the upper supporting frame 104 from its open position shown by the two-dot chain line to its closed position shown by the solid line and from the closed position shown by the solid line to the open position shown by the two-dot chain line is a circular arc about the central axis of pivotal movement of the upper supporting frame 104, i.e. the supporting shaft 114. In order for the interlocking linking gear 334 to come smoothly into and out of engagement with the interlocking input gear 336 by its movement in a circular arcuate track irrespective of the rotating angular positions which the interlocking linking gear 334 and the interlocking input gear 336 assume upon stopping of their rotation by the deenergization of the drive source 308, it is important that one of the gears 334 and 336 should be properly rotated over some angular range at the time of their engagement and disengagement.

In veiw of this fact, the illustrated copying apparatus constructed in accordance with this invention is improved in the following respect with regard to its interlocking mechanism comprised of the interlocking output gear 332, the interlocking linking gear 334 and the interlocking input gear 336.

Figure 9:
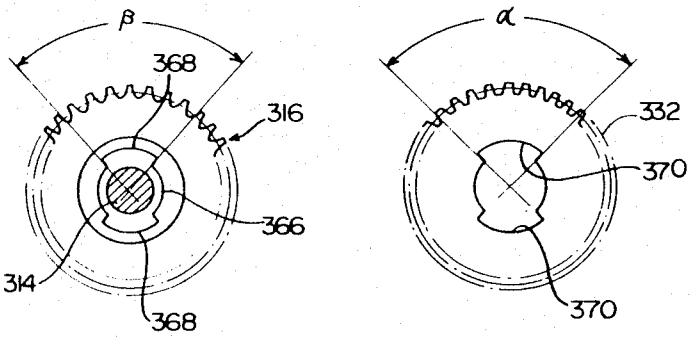
FIG. 9 is a simplified view showing the constituent elements of the interlocking mechanism shown in FIG. 8.
Figure 8:
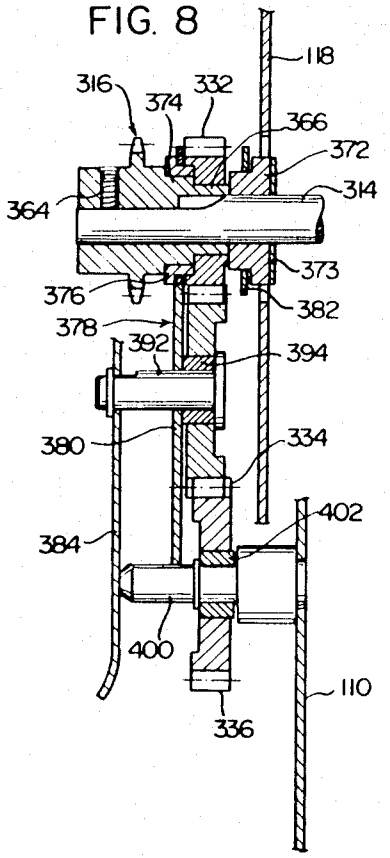
FIG. 8 is a partial sectional view showing an interlocking mechanism in the copying apparatus shown in FIG. 1 (taken along line VIII—VIII of FIG. 11)

Referring to FIG. 8, the output shaft 314 of the drive source 308 (FIG. 1) mounted on the upper supporting frame 104 is projected rearwardly (to the left in FIG. 8) beyond the vertical rear base plate 118 of the upper supporting frame 104. The interlocking output gear 332 is mounted on the projecting end portion of the output shaft 314 so that it can freely rotate over some angular range. Stated in detail, the sprocket wheel 316 constituting an input terminal of the second power transmission system 312 (FIG. 7) provided in the upper supporting frame 104 is fixed to the projecting end portion of the output shaft 314. This fixing is achieved by threadably fitting a setscrew 364, which abuts against, or is threadedly associated with, the output shaft 314, in a radial hole formed in the hub portion of the sprocket wheel 316. The sprocket wheel 316 has a small-diameter hub portion 366 at its right end portion in FIG. 8, and the interlocking output gear 332 is mounted on the small-diameter hub portion 366. With reference to FIGS. 8 and 9 together, one or more (two in the drawing) fan-shaped raised portions 368 are formed on the peripheral surface of the small-diameter hub portion 366 of the sprocket wheel 316. Correspondingly, one or more (two in the drawing) fan-shaped depressed portions 370 are formed on the inner circumferential surface of the interlocking output gear 332. By positioning the fan-shaped raised portions 368 in the fan-shaped depressed portions 370, the interlocking output gear 332 is mounted on the small-diameter hub portion 366. The angle of circumferential extension of each fan-shaped depressed portion 370 (angle $\alpha$ which is 90 degrees in the drawing) is slightly (by 6 degrees in the drawing) larger than the angle of the circumferential extension of the each fan-shaped raised portion 368 (angle $\beta$ which is 84 degrees in the drawing). Accordingly, the interlocking output gear 332 is mounted on the small-diameter hub portion 366 of the sprocket wheel 316 in such a manner that it can freely rotate over some angular range ($\alpha-\beta$) corresponding to the difference ($\alpha-\beta$) between the angle $\alpha$ and the angle $\beta$ with respect to the small-diameter hub portion 366 and the output shaft 314 to which the small-diameter hub portion 366 is fixed. Since the difference ($\alpha-\beta$) between the angle $\alpha$ and the angle $\beta$, i.e. the angular range over which the interlocking output gear 332 can freely rotate with respect to the output shaft 314, produces a play in driving connection, it should desirably be minimized, and more specifically, adjusted to a value corresponding to a free rotation angle to be allowed on the interlocking linking gear 334 for bringing the interlocking linking gear 334 smoothly into, and out of, engagement with the interlocking input gear 336 as will be stated hereinafter (generally at least a one-half pitch of the interlocking output gear 332). From this viewpoint, the above angular difference is desirably a value corresponding to one-half pitch of the interlocking output gear 332 (and the interlocking linking gear 334 in mesh therewith) or a slightly larger value. In the illustrated embodiment, the interlocking output gear 332 is mounted on the small-diameter hub portion 366 of the sprocket wheel 316 fixed to the output shaft 314. If desired, however, the interlocking output gear 332 can be directly mounted on the output shaft 314. Furthermore, in the illustrated embodiment, the fan-shaped raised portions 368 are formed on the peripheral surface of the small-diameter hub portion 366, and the fan-shaped depressed portions 370, on the inner circumferential surface of the interlocking output gear 332. Conversely, it is possible to form the fan-shaped depressed portions on the peripheral surface of the small diameter hub portion 366 and the fan-shaped raised portions on the inner circumferential surface of the interlocking output gear 332.

Figure 10:
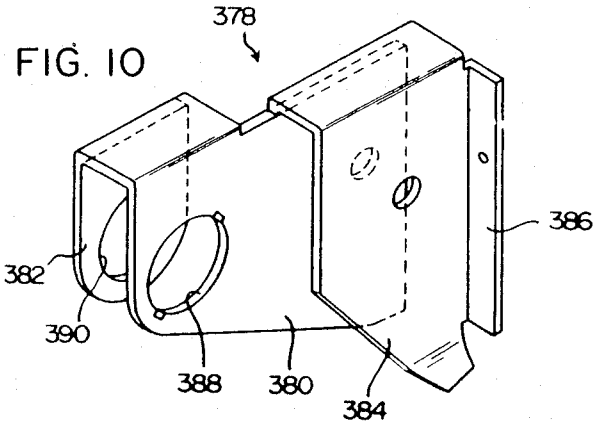
FIG. 10 is a perspective view showing the constituent elements of the interlocking mechanism shown in FIG. 8.
Figure 11:
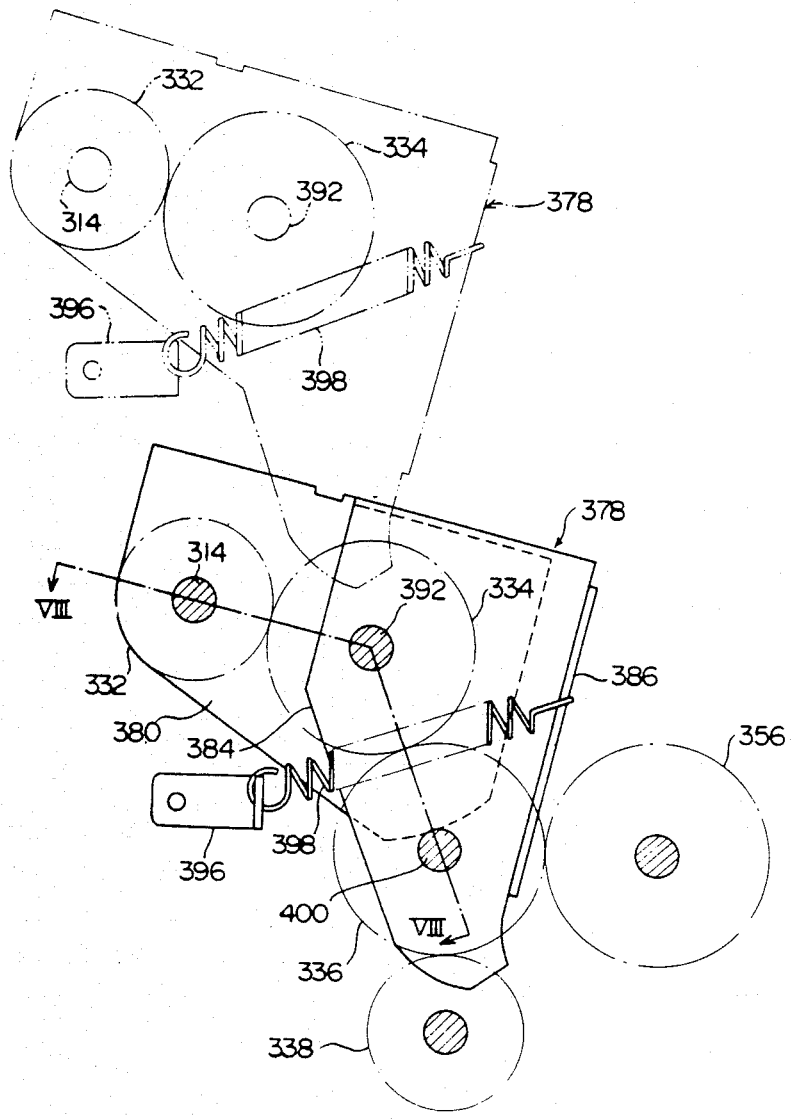
FIG. 11 is a simplified view showing the interlocking mechanism shown in FIG. 8.

Again with reference to FIG. 8, an annular member 372 having a small-diameter portion and a largediameter portion is rotatably mounted on the output shaft 314 of the drive source 308. The movement of the annular member 372 in the right direction in FIG. 8 is prevented by a stop plate 373 fixed to the output shaft 314. Furthermore, an annular member 376 having a small-diameter portion and a large-diameter portion is rotatably mounted on a medium-diameter hub portion 374 of the sprocket wheel 316 adjacent to the small-diameter hub portion 366. A pivot member 378 is fixed to the small-diameter portions of the annular members 372 and 376, and consequently, is pivotally mounted on the output shaft 314. Now, with reference to FIGS. 8 and 10 together, the pivot member 378 has a main portion 380, a supporting piece 382 projecting laterally from the upper edge of one end portion of the main portion 380 and then extending downwardly, and a guide piece 384 projecting laterally from the other end portion of the main portion 380 in a direction opposite to the supporting piece 382 and then extending downwardly. A protruding portion 386 is formed at one end of the guide piece 384. As clearly shown in FIG. 8, the lower end portion of the guide piece 384 is slightly curved in a direction away from the main portion 380, i.e. to the left in FIG. 8. Corresponding circular openings 388 and 390 are formed in the main portion 380 and the supporting piece 382 of the pivot member 378. The pivot member 378 is fixed to the annular members 372 and 376 by positioning the circular opening 390 of the supporting piece 382 around the small-diameter portion of the annular member 372, fixing the supporting piece 382 to the annular member 372 by a suitable means (not shown) such as a key, further positioning the circular opening 388 of the main portion 380 around the small-diameter portion of the annular member 376, and fixing the main portion 380 to the annular member 376 by a suitable means (not shown) such as a key. With reference to FIGS. 8 and 11 together, the pivot member 378 has fixed thereto a shaft 392 extending through the main portion 380 and the guide piece 384. To one end portion (the right end portion in FIG. 8) of the shaft 392 is rotatably mounted through a shaft supporting member 394 the interlocking linking gear 334 to be engaged with the interlocking output gear 332. Furthermore, as clearly shown in FIG. 11, a spring means 398 composed of a tension coil spring is stretched between a bracket member 396 fixed to the rear surface of the vertical rear base plate 118 of the upper supporting frame 104 and the protruding portion 386 of the pivot member 378. The spring means 398 elastically biases the pivot member 378 clockwise in FIG. 11 about the output shaft 314 as a center, and as shown by a two-dot chain line in FIG. 11, elastically maintains the pivot member 378 at an angular position shown by a two-dot chain line in FIG. 11 with respect to the output shaft 314 when the upper supporting frame 104 has been moved to the open position from the closed position and the interlocking linking gear 334 is not in mesh with the interlocking input gear 336 mounted on the lower supporting frame 102 (when the pivot member 378 is at this angular position, the tension coil spring constituting the spring means 398 assumes a so-called free length or the pivot member 378 abuts against a stationary stop piece (not shown), whereby further clockwise movement of the pivot member 378 in FIG. 11 is hampered).

Further, with reference mainly to FIG. 8, a shaft 400 projecting rearwardly (to the left in FIG. 8) beyond the vertical rear base plate 110 is fixed to the lower supporting frame 102. To the shaft 400 is rotatably mounted the interlocking input gear 336 by means of a shaft supporting member 402. In the illustrated embodiment, the shaft 400 has an extension projecting rearwardly a predetermined distance beyond the interlocking input gear 336. As will be seen from the following description, the extension of the shaft 400 constitutes a stop member against which the free edge, i.e. lower edge, of the main portion 380 of the pivot member 378 abuts when the upper supporting frame 104 is held at its closed position and the interlocking linking gear 334 is brought into engagement with the interlocking input gear 336. The front end of the shaft 400 guides the front surface (the right surface in FIG. 8) of the guide piece 384 of the pivot member 378 when the upper supporting frame 104 is brought to its closed position. Censequently, the free edge, i.e. lower edge, of the main portion 380 of the pivot member 378 is surely prevented from being displaced toward the base portion of the shaft 400 (to the right in FIG. 8) and damaging the interlocking input gear 336 upon collision.

The operation of the interlocking mechanism described hereinabove will be described briefly with reference to FIGS. 8 and 11. When in the last half of the closing movement of the upper supporting frame 104 from its open position (the position shown by the two-dot chain line in FIG. 7) to its closed position (the position shown by the solid line in FIG. 7), the interlocking output gear 332 and the interlocking linking gear 334 are moved from the position shown by a two-dot chain line in FIG. 11 to a position approaching the position shown by two-dot chain line in FIG. 11, the teeth of the interlocking linking gear 334 abut against the teeth of the interlocking input gear 336 mounted on the lower supporting frame 102. As a result, according to the further closing movement of the upper supporting frame 104, the pivot member 378 can be pivoted slightly counterclockwise about the output shaft 314 as a center against the elastic biasing action of the spring means 398, and thus the abutting of the teeth of the interlocking linking gear 334 against the teeth of the interlocking input gear 36 is elastically buffered. Since the interlocking output gear 332 is mounted on the output shaft 314 so that it can freely rotate over some range, the interlocking linking gear 334 and the interlocking output gear 332 in mesh therewith are slightly rotated, as required, substantially simultaneously with the aforesaid elastic buffering, and thus the interlocking linking gear 334 is fully smoothly engaged with the interlocking input gear 336. The rotation of the interlocking linking gear 334 and the interlocking output gear 332 is also effected when the pivot member 378 is slightly pivoted countercloclwise about the output shaft 314 as a center against the elastic biasing action of the spring member 398 and thereby the linking gear 334 is slightly turned around the output gear 332. Accordingly, even when the teeth of the linking gear 334 abut against the teeth of the input gear 336 in alignment with each other, the linking gear 334 can be fully smoothly engaged with the input gear 336. While the linking gear 334 is in engagement with the input gear 336, the elastic biasing action of the spring means 398 causes the pivot member 378 to pivot clockwise in FIG. 11 about the output shaft 314 as a center, and as clearly shown in FIGS. 8 and 11, the free edge, i.e. lower edge, of the main portion 380 of the pivot member 378 abuts against the upper surface of the extension of the shaft 400 and is maintained elastically in this conditon. Consequently, the distance between the shaft 400 on which the input gear 336 is mounted and the shaft 392 on which the linking gear 334 is mounted is maintained at a predetermined value, and the engagement between the linking gear 334 and the input gear 336 is surely maintained in the required condition. Furthermore, as stated hereinabove, it will be easily understood from FIG. 8 that when the pivot member 378 is moved toward the postion shown by the solid line in FIG. 11, the front surface (the right surface in FIG. 8, and the back surface in FIG. 11) of the guide piece 384 of the pivot member 378 is guided by the front end of the shaft 400, whereby the main portion 380 of the pivot member 378 is surely prevented from being displaced toward the base portion of the shaft 400 (toward the right in FIG. 8) and damaging the input gear 336 upon collision therewith. When the upper supporting frame 104 is moved from its closed position (the position shown by the solid line in FIG. 7) toward its open position (the position shown by the two-dot chain line in FIG. 7) and the linking gear 334 is disengaged from the input gear 336, the linking gear 334 and the output gear 332 in mesh therewith are slightly rotated as required, and thus, the linking gear 334 is fully smoothly disengaged from the input gear 336.

In the above-described specific embodiment, the interlocking output gear 332 is mounted on the output shaft 314 of the drive source 308 and the pivot member 378 is mounted on the output shaft 314 of the drive source 308. If desired, it is possible to provide another shaft drivingly connected to the output shaft 314 of the drive source 308 and mount the interlocking output gear 332 and the pivot member 378 on this shaft. Furthermore, in the above-described specific embodiment, the pivot member 378 is provided in the upper supporting frame 104 in relation to the interlocking output gear 332, and the interlocking linking gear 334 is mounted on the pivot member 378. If desired, it is possible to provide the pivot member 378 in the lower supporting frame 102 in relation to the interlocking input gear 336 and to mount the interlocking linking gear 334 on the pivot member 378 so provided. In this case, it is necessary to maintain the interlocking input gear 336 instead of the interlocking output gear 332 freely rotatable over some angular range with respect to the first power transmission system 310 provided in the lower supporting frame 102.

Copying paper feed device

The construction of the copying paper feed device 40 will be described in detail with reference to FIGS. 1 and 12-A together. The illustrated paper feed device 40 is composed of a combination of the paper cassette receiving section 46, and the paper cassette 50 loaded in the cassette receiving section 46 through the opening 48 formed in the right wall of the housing 2, as already mentioned hereinabove.

The copying paper cassette 50 includes a box-like cassette case 404 at least the top front end portion of which is open. Inwardly of the two side walls of the cassette case 404 are disposed guide plates 406 for regulating both side edges of a layer 52 of copying paper sheets received in the cassette casing 404 (in FIGS. 1 and 12-A, only one of the guide plates 406 is shown). A bottom plate 408 is disposed between the guide plates 406 within the cassette case 404. The rear end of the bottom plate 408 is pivotally connected to the bottom wall of the cassette case 404 by, for example, inserting a suspending piece formed there into a hole formed in the bottom wall of the cassette case 404. A spring means 410 composed of a compression coil spring is interposed between the front end portion of the bottom plate 408 and the bottom wall of the cassette case 404. The spring means 410 elastically biases the front end portion of the bottom plate 408 upwardly. The copying paper sheet layer 52 is accommodated in the cassette case 404 while at least its front portion is placed on the bottom plate 408. Hence, the front end portion of the copying paper sheet layer 52 is also elastically biased upwardly by the spring means 410. Within the cassette case 404 are disposed a pair of separating claw members 412 (only one of the separating claw portions 412 is shown in FIGS. 1 and 12-A). Each separating claw member 412 has a supporting portion 414 located between the side wall of the cassette case 404 and the guide plate 406 and a separating claw portion 416 extending inwardly from the upper edge of the front end of the supporting portion 414 and adapted to be kept in stoppage on the front end corner portion of the upper surface of the copying paper sheet layer 52. The upper end portion of the rear portion of the supporting portion 414 is pivotally connected to the guide plate 406 (or the side wall of the cassette case 404) by a pin 418, and the separating claw members 412 are free to pivot about the pin 418 as a center. The clockwise pivoting of the separating claw members 412 in FIG. 12-A is restricted by the abutting of the rear end edge of the supporting portion 414 against the bottom wall of the cassette case 404.

The cassette receiving section 46 includes a receiving stand 420 for guiding and supporting the cassette 50 to be inserted through the opening 48 formed in the right wall of the housing 2. The receiving stand 420 has a substantially horizontally extending upper surface 422 for guiding and supporting the bottom surface of the cassette 50 and both side surfaces 424 (only one of which is shown in FIG. 12-A) for guiding both side surfaces of the cassette 50 and defining the position of the cassette 50 in a direction perpendicular to the sheet surface in FIG. 12. At the downstream edge of the receiving stand 420 is located a suspending piece 426 suspending from the upstream edge of the guide plate 66, and the advancing of the cassette 50 along the receiving stand 420 is restricted by the abutting of the front surface of the cassette 50 against the suspending piece 426 (FIG. 12-C). Above the receiving stand 420, a rotatably mounted rotating shaft 428 is located, and one or more feed rollers 44 (in the drawing, two longitudinally spaced feed rollers 44) are mounted on the rotating shaft 428. Furthermore, one or more (two in the drawing) irregular arcuate members 430 are mounted on the rotating shaft 428. The irregular arcuate members 430 constitute a guide member which prevents the uppermost copying paper in the sheet-like paper layer 52 in the cassette 50 from contacting the feed rollers 44 or reduces the degree of contact when the cassette 50 is loaded in the cassette receiving section 46. With reference to FIGS. 12-A and 13 together, the rotating shaft 428 is rotatably mounted on the vertical front base plate 108 and the vertical rear base plate 110 of the lower supporting frame 102 through a shaft supporting member 432. One end portion (the right end portion in FIG. 13) of the rotating shaft 428 projects rearwardly (to the right in FIG. 13) beyond the vertical rear base plate 110, and to the projecting end of the rotating shaft 428, a rotating input element 436 is mounted rotatably through a shaft supporting member 434. The rotating input element 436 has formed integrally therewith the sprocket wheel 346 and the gear 352 which are constituent elements of the first power transmission system 310 described hereinabove. As already stated hereinabove with regard to FIG. 7, the sprocket wheel 346 is drivingly connected to the drive source 308 (FIG. 1), and the gear 352 is in mesh with the gear 354 connected to the feed roller 62 (FIG. 1) of the manual feed device 42 so that it rotates as a unit with the roller 62. A spring clutch means of a unique construction shown generally at 438 (which will be described in greater detail hereinafter) is disposed between the rotating shaft 428 and the rotating input element 436. Two supporting sleeves 440 spaced from each other a predetermined distance are fixed to the main portion of the rotating shaft 428, i.e. that portion which exists between the verical front base plate 108 and the vertical rear base plate 110 of the lower supporting frame 102. Auxiliary sleeves 442 are also fixed outwardly of the supporting sleeves 440 with some distance. The feed rollers 44 preferably formed of a material having a relatively high coefficient of friction such as a synthetic rubber are fixed to the peripheral surfaces of the two supporting sleeves 440, respectively. On the other hand, between each of the supporting sleeves 440 and each of the auxiliary sleeves 442, the irregular arcuate member 430 is rotatably mounted on the rotating shaft 428. As clearly shown in FIG. 12-A, each irregular arcuate member 430 has a guiding arcuate portion 444 extending beyond the peripheral surface of the feed roller 44 and a non-acting portion 446 located back from the peripheral surface of the feed roller 44. Desirably, a boundary area 448 between the guiding arcuate portion 444 and the non-acting portion 446, particularly the boundary area 448 positioned on the right in FIG. 12-A, is defined by a gentle curve. Preferably, at least the surface of the guiding arcuate portion 444 of the irregular arcuate member 430 and the surface of the boundary area located on the right in FIG. 12-A are formed of a material having a relatively low coefficient of friction (for example, a suitable plastic material).

Figure 13:
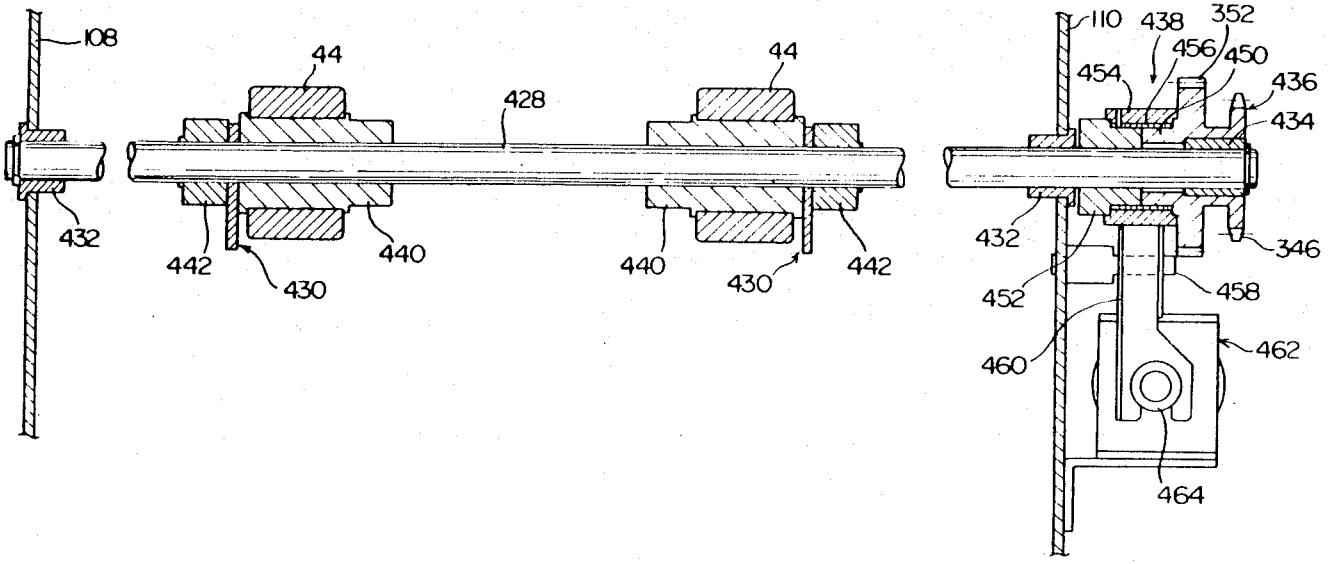
FIG. 13 is a partial sectional view showing a part of a copying paper feed device in the copying apparatus shown in FIG. 1.

In the paper feed device 40 described above, before the cassette 50 is loaded into the cassette receiving section 46, the irregular arcuate members 430 are positioned at the angular position indicated in FIG. 12-A due to their own position of the center of gravity. When as shown in FIG. 12-A, the front end portion of the cassette 50 is inserted through the opening 48 formed in the right wall of the housing 2 and placed on the receiving stand 420 and then the cassette 50 is advanced, the leading edge of the uppermost copying paper in the copying paper sheet layer 52 in the cassette case 404 abuts against the guiding arcuate portions 444 of the irregular arcuate members 430. It will be seen easily by referring to FIG. 12-B that when the cassette 50 is further advanced, the bottom plate 408 and the front end portion of the copying paper sheet layer 52 placed thereon are lowered by the action of the guiding arcuate portions 444 of the irregular arcuate members 430 against the elastic biasing action of the spring members 410. Furthermore, as the cassette 50 is advanced, the irregular arcuate members 430 are rotated clockwise in FIG. 12-B. When the cassette 50 is further advanced to a position at which the front surgace of the cassette 50 abuts against the suspending piece 426 as shown in FIG. 12-C, the irregular arcuate members 430 are rotated to the angular position shown in FIG. 12-C, and the boundary area 448 makes contact with the upper surface of the uppermost copying paper of the copying paper sheet layer 52. As a result, as can be easily understood from a comparison of FIG. 12-B with FIG. 12-C, the irregular arcuate members 430 are further rotated slightly in the clockwise direction in FIG. 12-C by the elastic biasing action of the spring means 410, and the bottom plate 408 and the front end portion of the copying paper sheet layer 52 placed on it are elevated. Consequently, the upper surface of the uppermost copying paper sheet in the copying paper sheet layer 52 is pressed by the feed roller 44. The extending angle range of the guiding arcuate portion 444 of the irregular arcuate member 430 should be set such that when the cassette 50 is inserted to the position shown in FIG. 12-C, not the guiding arcuate portion 444 but the boundary area 448 of the irregular arcuate member 430, rotated clockwise in FIG. 12-C upon insertion of the cassette 50, makes contact with the upper surface of the uppermost copying paper sheet in the copying paper sheet layer 52. Accordingly, when the cassette 50 is loaded into the cassette receiving section 46, the bottom plate 408 and the front end portion of the copying paper sheet layer 52 placed on it are lowered by the action of the irregular arcuate members 430 against the elastic biasing action of the spring means 410. Thus, the uppermost copying paper sheet in the copying paper sheet layer 52 is substantially prevented from contacting the peripheral surface of the feed roller 44 and thereby being adversely affected. The irregular arcuate members 430 performing the abovementioned operation are rotatably mounted on the rotating shaft 428 to which the feed roller 44 is fixed, in the embodiment described above. If desired, however, it is possible to provide another shaft extending substantially parallel, and in proximity, to the rotating shaft 428 and mount them on this shaft. As shown in FIG. 12-C, when the cassette 50 has been loaded in the cassette-receiving section 46 as required, the rotating shaft 428 is connected to the rotating input element 436 (FIG. 13) by the action of the spring clutch means 438 (FIG. 13). Thus, when the rotating shaft 428 and the feed roller 44 fixed thereto are rotated cloclwise in FIG. 12-C, the uppermost copying paper sheet in the copying paper sheet layer 52 is separated from the other paper sheets, and delivered to the left in FIG. 12-C, by the feeding action of the feed roller 44 and the separating action of the separating claw portion 416 of the separating claw member 412.

In a conventional copying paper feed device 40, a spring clutch means which does not permit free rotation of the rotating shaft 428 but hampers its rotation when it is not operating (i.e. when the rotation of the rotation input element 436 is not transmitted to the rotatint shaft 428) is used as a clutch means for choosing between the rotating input element 436 and the rotating shaft 428. However, when the free rotation of the rotating shaft 428 is not permitted, the following problem exists. When the cassette 50 is loaded into the cassette reeiving section 46, the action of the irregular arcuate members 430 makes it possible to substantially prevent the uppermost copying paper in the sheet-like copying paper layer 52 from contacting the peripheral surface of the feed roller 44 and being adversely affected. But as can be easily seen from FIG. 12-C, when the cassette 50 is removed from the cassette-receiving section 46, the irregular arcuate members 430 do not function, and the cassette 50 is pulled out to the right in FIG. 12-C while the uppermost copying paper in the sheet-like copying paper layer 52 remains in contact with the feed roller 44 which is not permitted to rotate freely. As a result, the upper most copying paper kept in contact with the feed roller 44 not permitted to rotate freely is not moved incident to the movement of the cassette 50, but is displaced relative to the cassette 50 and partly comes out of the cassette case 404. In order to solve this problem, in the conventional copying paper feed device, a one-way clutch is interposed between the rotating shaft 428 and the feed roller 44 so that the feed roller 44 can freely rotate counterclockwise in FIG. 12-C (in a direction opposite to the feeding direction) with respect to the rotating shaft 428 which is not permitted to rotate freely. According to such a solution, the one-way clutch must be used additionally and this increases the cost. To solve the above problem without using the one-way clutch, it may be possible to use between the rotating input element 436 and the rotating shaft 428 another form of clutch means such as an electromagnetic clutch permitting free rotation of the rotating shaft 428 when it is not operating. But such a conventional clutch means as an electromagnetic clutch which permits free rotation of the rotating shaft 428 during its non-operating period has the defect of being relatively expensive.

In contrast, in the copying paper feed device 40 improved in accordance with this invention, there is used the clutch means 438 of a unique structure which is relatively simple and inexpensive and permits free rotation of the rotating shaft 428 during its nonoperating period.

Figure 14:
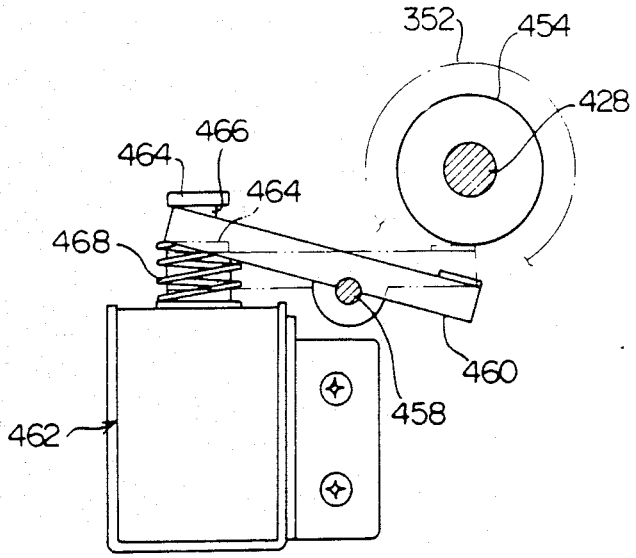
FIG. 14 is a partial simplified view showing a part of a spring clutch means provided in relation to a copying paper feed device in the copying apparatus shown in FIG. 1.

With reference to FIG. 13, the spring clutch means 438 includes a tubular rotating element 454 idly fitted in the hub portion 450 formed in the rotation input element 436 and the small-diameter portion of a tubular member 452 fixed to the rotating shaft 428, and a coil spring 456 disposed inwardly of the rotating element 454. One end of the coil spring 456 is fixed to the hub portion 450 of the rotating input element 436, and its other end is fixed to the rotating element 454. The wrapping direction of the coil spring 456 wrapped about the hub portion 450 of the rotating input element 436 and the small-diameter portion of the tubular member 452 is anticlockwise when viewed from right in FIG. 13. With reference to FIGS. 13 and 14 together, the spring clutch means 438 further comprises a friction member 460 mounted pivotally on a supporting pin 458 projecting to the right in FIG. 13 and fixed firmly in the vertical rear base plate 110 of the lower supporting frame 102 and a control means for selectively holding the friction member 460 at a non-operating position shown by a solid line in FIG. 14 and an operating position shown by a two-dot chain line in FIG. 14. In the illustrated embodiment, the main portion of the control means is constructed of a solenoid 462 fixed to the vertical rear base plate 110. The solenoid 462 has an iron core 466 having an enlarged head portion 464 and a compression coil spring 468 received about the axial portion of the iron core 466. One end of the friction member 460 is bifurcated to receive the axial portion of the iron core 466 of the solenoid 462. When the solenoid 462 is deenergized and the iron core 466 is at its projecting position shown by a solid line in FIG. 14 by the elastic biasing action of the spring 468, the friction member 460 is held at its non-operating position shown by the solid line in FIG. 14. On the other hand, when the solenoid 462 is energized and the iron core 466 is held at its retracted position shown by a two-dot chain line in FIG. 14 against the elastic biasing action of the spring 468, the friction member 460 is held at its operating position shown by the two-dot chain line in FIG. 14. When the friction member 460 is held at its operating position shown by the two-dot chain line in FIG. 14, the other end, i.e. the free end, of the friction member 460 is pressed against the peripheral surface of the rotating element 454. Conveniently, a high friction material having a high coefficient of friction such as a nonwoven fabric is bonded to the surface of the free end of the friction member 460 which is to be pressed against the peripheral surface of the rotating element 454. Alternatively, such a high friction material may be bonded to the peripheral surface of the rotating element 454.

The operation of the spring clutch means 438 described above is described below at some length. When the solenoid 462 is deenergized and therefore the friction member 460 is held at its non-operating position shown by the solid line in FIG. 14, the rotating element 454 can freely rotate without any restriction. In this state, the rotation of the rotating input element 436 drivingly connected to the drive source 308 (FIG. 1) and rotating counterclockwise as viewed from right in FIG. 13 is transmitted through the coil spring 456 to the rotating element 454 capable of freely rotating, and the coil spring 456 and the rotating element 436 are rotated incident to the rotation of the rotating input element 436. At this time, the coil spring 456 having one end fixed to the rotating input element 436 and the other end to the rotating element 454 does not shrink since it is not restrained whatsoever by the rotating element 454 and freely rotate incident to the rotation of the rotating input element 436. Hence, the tubular member 452 and the rotating shaft 428 fixed to it are permitted to rotate freely in both directions without any restraining. On the other hand, when the solenoid 426 is energized and the friction member 460 is held at its operating position shown by the two-dot chain line in FIG. 14, the free end of the friction member 460 is pressed against the peripheral surface of the rotating element 454 and thereby a frictional resistance is exerted on the rotation of the rotating element 454. As a result, the coil spring 456 wrapped from one end fixed to the rotation input element 436 to the other end fixed to the rotating element 454 anticlockwise as viewed from right in FIG. 13 is shrunken and wrapped tightly about the hub portion 450 of the rotation input element 436 and the small-diameter portion of the tubular member 452 fixed to the rotating shaft 428 because its one end is forcibly rotated counterclockwise as viewed from right in FIG. 13 by the rotating input element 436 whereas the other end undergoes a resistance force by the frictional resistance exerted on the rotating element 454. Consequently, the rotating input element 436, the tubular member 452 and the rotating shaft 428 to which the tubular member 452 is fixed are connected by the coil spring 456, and therefore, the rotating shaft 428 is rotated counterclockwise, i.e. in the feeding direction, as viewed from right in FIG. 13 incident to the rotation of the rotation input element 436. The shrunken coil spring 456 and the rotating element 454 to which the aforesaid other end of the coil spring 456 is fixed are rotated counterclockwise as viewed from right in FIG. 13 against the frictional resistance and incident to the rotation of the rotating input element 436 while it continues to undergo a frictional resistance by the friction member 460 pressed against the peripheral surface of the rotating element 454 (and therefore, while the coil spring 456 continues to be maintained shrunken).

In the copying paper feed device 40 utilizing the spring clutch means 438 described above, the rotating shaft 428 and the feed rollers 44 fixed thereto are allowed to rotate freely during the non-operating period of the spring clutch means 438, namely during the deenergization of the solenoid 462. Accordingly, even when the uppermost copying paper sheet in the copying paper sheet layer 52 in the cassette case 404 contines to be in contact with the feed roller 44 at the time of removing the cassette 50 from the cassette receiving section 46, the feed roller 44 is properly rotated in a direction opposite to the feeding direction in response to the movement of the uppermost copying paper, and therefore, the aforesaid problem does not arise.

When the spring clutch means 438 described above is utilized, the rotating shaft 428 and the feed roller 44 fixed thereto are allowed to rotate freely during the non-operating period of the spring clutch means 438, namely during the deenergization of the solenoid 462. Hence, at the time of loading the cassette 50 into the cassette-receiving section 46, too, the uppermost copying paper sheet in the copying paper sheet layer in the cassette case 404 is prevented from being adversely affected by the feed roller 44 upon contact therewith. If desired, therefore, the aforesaid irregular arcuate members 430 may be omitted. However, if the irregular arcuate members 430 are omitted, the following undesirable tendency arises. As can be easily understood from FIG. 12-A, at the time of loading the cassette 50 into the cassette receiving section 46, the leading edge of the uppermost copying paper sheet in the copying paper sheet layer 52 accommodated in the cassette case 404 abuts directly against the peripheral surface of the feed roller 44 not tangent, but nearly normal thereto. The feed roller 44 is generally formed of a material having a relatively high coefficient of friction in order to perform surely its inherent function of feeding copying paper. When the leading edge of the uppermost copying paper sheet in the copying paper sheet layer 52 abuts nearly normal against the peripheral surface of the feed roller 44, its forward movement tends to be hampered by the feed roller 44 even when the feed roller 44 can freely rotate.

Figure 15:
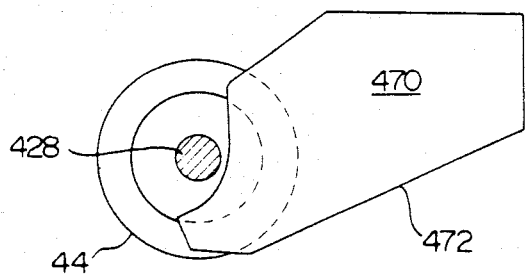
FIG. 15 is a partial simplified view showing a stationary guide plate which can be used in a copying paper feed device in the copying apparatus shown in FIG. 1.

To avoid this undesirable tendency, a stationary guide plate 470 of the form illustrated in FIG. 15 may be used instead of the irregular arcuate member 430. It is important that the stationary guide plate 470, conveniently fixed in a required position with regard to each of the feed rollers 44 fixed to the rotating shaft 428, should have a guiding lower edge 472 extending inclinedly downwardly in the inserting direction (in the left direction in FIG. 15) of the cassette 50 (FIG. 12-A, for example). The guiding lower edge 472 extends inclinedly downwardly in the inserting direction of the cassette 50 and further extends substantially horizontally. It is important that the front end portion of the guiding lower edge 472 should be located slightly above the lower end of the peripheral surface of the feed roller 44 (if the front end portion of the guiding lower edge 472 projects downwardly beyond the lower end of the peripheral surface of the feed roller 44, the upper most copying paper in the sheet-like copying paper layer 52 in the loaded cassette 50 is prevented from contacting the peripheral surface of the feed roller 44, and therefore, the action of the feed rollers 44 to feed the copying paper is hampered). At least the guiding lower edge 472 of the stationary guide plate 470 is desirably formed of a suitable plastic material or the like having a low coefficient of friction.

When the stationary guide plate 470 is provided, the uppermost copying paper sheet in the sheet-like copying paper layer 52 abuts against the guiding lower edge 472 of the stationary guide plate 470 at the time of inserting the cassette 50 into the cassette-receiving section 46 and advances along the guiding lower edge 472 (at this time, the bottom plate 408 and the front end portion of the copying paper sheet layer 52 placed thereon are gradually lowered against the elastic biasing action of the spring means 410 by the action of the guiding lower edge 472). Then, the uppermost copying paper sheet leaves the guiding lower edge 472 at its front end portion and comes into contact with the peripheral surface of the feed rollers 44. At this time, as can be easily understood from FIG. 15, the leading edge of the uppermost copying paper sheet in the copying paper sheet layer 52 abuts nearly tangentially against the peripheral surface of the feed rollers 44, and therefore, the aforesaid undesirable tendency is avoided.

Fixing Device

Now, with reference to FIG. 16, the construction of the fixing device shown generally at 80 will be described. The illustrated fixing device 80 includes a driven fixing roller 474 and a follower fixing roller 476. The driven fixing roller 474 is composed of a hollow cylindrical member 478 rotatably mounted and adapted to rotate in the direction shown by an arrow and an electrical heating element 480 disposed within the hollow cylindrical member 478. The hollow cylindrical member 478 can be made of a suitable metal such as an aluminum-base alloy having a suitable surface coating, such as a Teflon (trademark) coating, which effectively prevents adhesion of a toner. The electrical heating element 480 may be a resistance heater extending longitudinally of, and within, the hollow cylindrical member 478. On the other hand, the follower fixing roller 476 rotatably supported and adapted to be in press contact with the driving fixing roller 474 is conveniently formed of a suitable flexible material such as a synthetic rubber.

As already stated, the fixing device 80 is entirely mounted on the lower supporting frame 102. Hence, even when the upper supporting frame 104 is held at its open position, the conveying passage for a sheet material such as copying paper which passes through the fixing device 80 is not opened (see FIGS. 1 and 2 also). Thus, the illustrated embodiment is constructed such that after the upper supporting frame 104 is held at its open position, the conveying passage for a sheet material passing through the fixing device 80 can also be opened as required. This construction will be described in detail. The illustrated fixing device 80 has a movable supporting frame 484 mounted on the shaft 400 so that it can pivot freely between a closed position shown by a solid line in FIG. 16 and an open position shown by a two-dot chain line in FIG. 16. The shaft 400 itself is fixed to the vertical front base plate 108 and the vertical rear base plate 110 (FIG. 3) of the lower supporting frame 102. As already described with reference to FIG. 8, the rear end portion of the shaft 400 projects rearwardly beyond the vertical rear base plate 110, and the interlocking input gear 336 is rotatably mounted on the shaft 400. The movable supporting frame 484 has a pair of end walls 486 (one of which is shown in FIG. 16) spaced from each other a predetermined distance in the front-rear direction, and an upper wall 488. To the left end portion in FIG. 16 of the movable supporting frame 484 is fixed a shaft 490 extending across the two end walls 486, and hooks 492 are respectively mounted pivotally on the opposite end portions of the shaft 490 (FIG. 16 shows only the hook 492 mounted on the rear end portion of the shaft 490). A projecting portion 496 projecting upwardly through an opening 494 formed in the upper wall 488 of the movable supporting frame 484 is formed integrally in the hook 492. Conveniently, the hooks 492 mounted on the front and rear end portions of the shaft 490 respectively are connected to each other by a lateral member 498 extending across the projecting portions 496 so that they are interlocked with each other. In relation to each of the hooks 492 is provided a spring means 500 composed of a torsion coil spring one end of which is engaged with the shaft 490 and the other end of which is engaged with the hook 492. The spring means 500 elastically biases the hook 492 counterclockwise in FIG. 16. When the movable supporting frame 484 is at its open position shown by the two dot chain line in FIG. 16, the engaging end 502 of the hook 492 abuts against the edge of the end wall 486 of the movable supporting frame 484 thereby preventing the hook 492 from further pivoting counterclockwise, and the hook 492 is elastically held at this angular position by the spring means 500. On the other hand, in relation to the hook 492, an engaged member 504 is fixed between the vertical front base plate 108 and the vertical rear base plate 110 (FIG. 3) of the lower supporting frame 102. When the movable supporting frame 484 is pivoted counterclockwise from the open position shown by the two-dot chain line in FIG. 16 to a point near the closed position shown by the solid line in FIG. 16, the inclined lower edge 506 of the hook 492 abuts against the engaged member 504, and after that, the hook 492 is privoted clockwise against the elastic biasing action of the spring means 500 in response to the counterclockwise pivoting of the movable supporting frame 484. When the engaging end 502 goes past the engaged member 504, the hook 492 is pivoted counterclockwise about the shaft 492 as a center by the elastic biasing action of the spring member 500, whereby the movable supporting frame 484 is surely locked in the closed position shown by the solid line in FIG. 16. When the hook 492 is in engagement with the engaged member 504, some space is conveniently formed between the engaging end 502 of the hook 492 and the edge of the end wall. To hold the movable supporting frame 484 at the closed position shown by the two-dot chain line in FIG. 16, the projecting portion 496 of the hook 492 or the laterial member 498 is operated to pivot the hook 492 clockwise against the elastic biasing action of the spring means 500 and to detach it from the engaged member 504 and thereafter, the movable supporting frame 484 is pivoted counterclockwise. If desired, when the movable supporting frame 484 is pivoted to the open position shown by the two-dot chain line in FIG. 16, a stationary stop piece (not shown) against which the upper wall 488 or the end wall 486 abuts is fixed to the vertical front base plate 108 and/or the vertical rear base plate 110 (FIG. 3) of the lower supporting frame 102, whereby the movable supporting frame 484 is prevented from pivoting further beyond the open position.

The driven fixing roller 474 in the fixing device 80 is mounted on the movable supporting frame 484 described above. More specifically, shaft portions 506 (see FIG. 17) formed on the opposite ends of the hollow cylindrical member 478 of the driven fixed roller 474 are respectively mounted rotatably on the two end walls 486 of the movable supporting frame 484. As can be understood from FIGS. 7 and 17, the shaft portion 506 formed at the rear end of the hollow cylindrical member 478 of the driven fixing roller 474 projects rearwardly beyond the vertical rear base plate 110 of the lower supporting frame 102 together with the rear end wall 486 of the movable supporting frame 484 (therefore, the vertical rear base plate 110 has formed therein a cut which permits the movement of the shaft portion 506 when the movable supporting frame 484 is pivoted between the closed position and the open position, although the cut is not shown in the drawings). To such a projecting portion of the shaft portion 506 is fixed the gear 356 engaged with the interlocking input gear 336 mounted rotatably on the shaft 400 (since the movable supporting frame 484 is pivoted about the shaft 400 on which the interlocking input gear 336 is mounted, the pivoting of the movable supporting frame 484 does not obstruct the engagement between the interlocking input gear 336 and the gear 356). Accordingly, it will be easily appreciated from FIG. 7 that the hollow cylindrical member 478 of the driven fixing roller 474 is drivingly connected to the output shaft 314 of the drive source 308 (FIG. 1) through the interlocking input gear 336, the interlocking linking gear 334 and the interlocking output gear 332, and is rotated in the direction shown by an arrow when the drive source 308 is energized. The movable supporting frame 484 further has a supporting plate 508 fixed to, and between the two end walls 486, and a plurality of suspending guide plates 510 (see FIG. 24 also) are fixed to the lower surface of the supporting plate 508 at intervals in the frontrear direction (a direction perpendicular to the sheet surface in FIG. 16). On the other hand, a guide plate 512 located below the suspending guide plate 510 is mounted between the vertical front base plate 108 and the vertical base plate 110 of the lower supporting frame 102 (see FIG. 24 also).

In the fixing device 80 described above, a sheet material such as copying paper having a transferred toner image on its upper surface is guided by a guide plate 511 disposed on the inlet side of the fixing device 80, introduced into the nip position between the driven fixing roller 474 and the follower fixing roller 476, and conveyed by the cooperative movement of the driven fixing roller 474 and the follower fixing roller 476 rotating in the direction of arrows. During this . time, the toner image is heat-fixed onto the surface of the sheet material. Then, the sheet material having the heat-fixed toner image is advanced between the suspending guide plates 510 and the guide plate 512, and sent to a sheet material conveying mechanism shown generally at 514 (the sheet material conveying mechanism 514 will be discribed in detail hereinafter). Thereafter, it is discharged onto the receiving tray 84 through the opening 82 formed in the left wall of the housing 2 by the action of the sheet material conveying mechanism 514.

Figure 16:
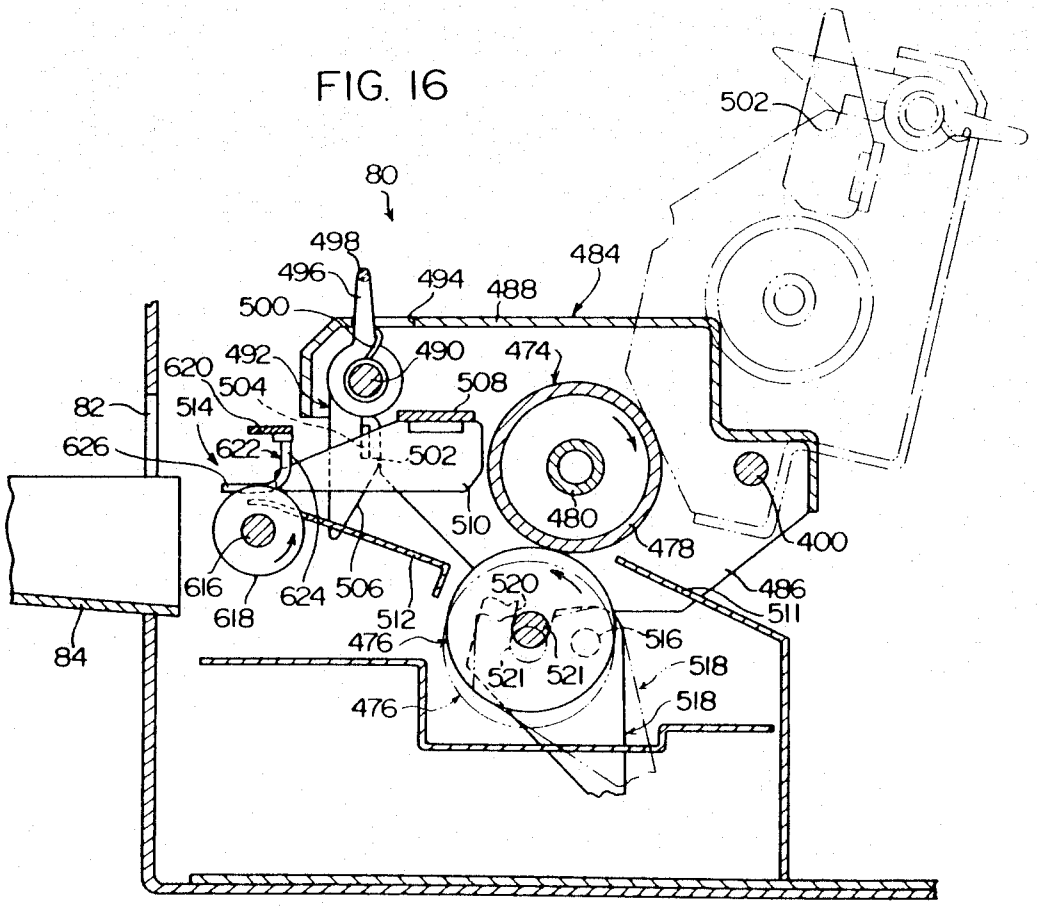
FIG. 16 is a partial sectional view showing a fixing device in the copying apparatus shown in FIG. 1.

When it becomes necessary to open the conveying passage for the sheet material in the fixing device 80 in order to repair, inspect or clean the driving fixing roller 474 and/or the follower fixing roller 476 or to remove the sheet material that has jammed up in the fixing device 80, or for other reasons, the upper supporting frame 104 is held at its open position (see FIG. 2)and then the movable supporting frame 484 is moved from its closed position shown by the solid line in FIG. 16 to its open position shown by the two-dot chain line in FIG. 16.

Selective Press-Contacting of the Follower Fixing Roller

In the fixing device 80 described with reference to FIG. 16, when the drive source 308 (FIG. 3) is energized, the driven fixing roller 474 and the follower fixing roller 476 to be brought into press contact with it are rotated in the direction of an arrow, and stopped upon deenergization of the drive source 308. As already stated hereinabove, the follower fixing roller 476 is desirably made of a flexible and soft material such as a synthetic rubber. If the follower fixing roller 476 made of such a flexible and soft material contines to be in press contact with the driven fixing roller 474 when the driven fixing roller 474 and the follower fixing roller 476 are stopped by the deenergization of the drive source 308, the following problem arises. Specifically, when the follower fixing roller 476 remains in press contact with the driven fixing roller 474 during stoppage of these rollers 474 and 476, a specified angular position of the follower fixing roller 476 continues to be in press contact with the driven fixing roller 474. Consequently, the follower fixing roller 476 made of the flexible material is deformed locally at the aforesaid specified angular position, and this leads to an adverse effect on the fixing action of the roller afterward. To avoid this problem, in the fixing device 80 in the copying apparatus improved in accordance with this invention, at least one end (preferably both ends) of the follower fixing roller 476 is mounted so that it can move between a press-contacting position and an isolated position. When the drive source 308 is energized, that end of the follower fixing roller 476 is held at the presscontacting position whereby the follower fixing roller 476 is brought into press contact with the driven fixing roller 474. When the drive source 308 is deenergized, that end of the follower fixing roller 476 is moved to the isolated postion whereby the follower fixing roller 476, at least over a greater portion of its longitudinal direction, preferably over its entire longitudinal portion, is completely separated from, or maintained out of press contact with (maintained in light contact with), the driven fixing roller 474, and consequently, the pressure between them is substantially released.

Figure 17:
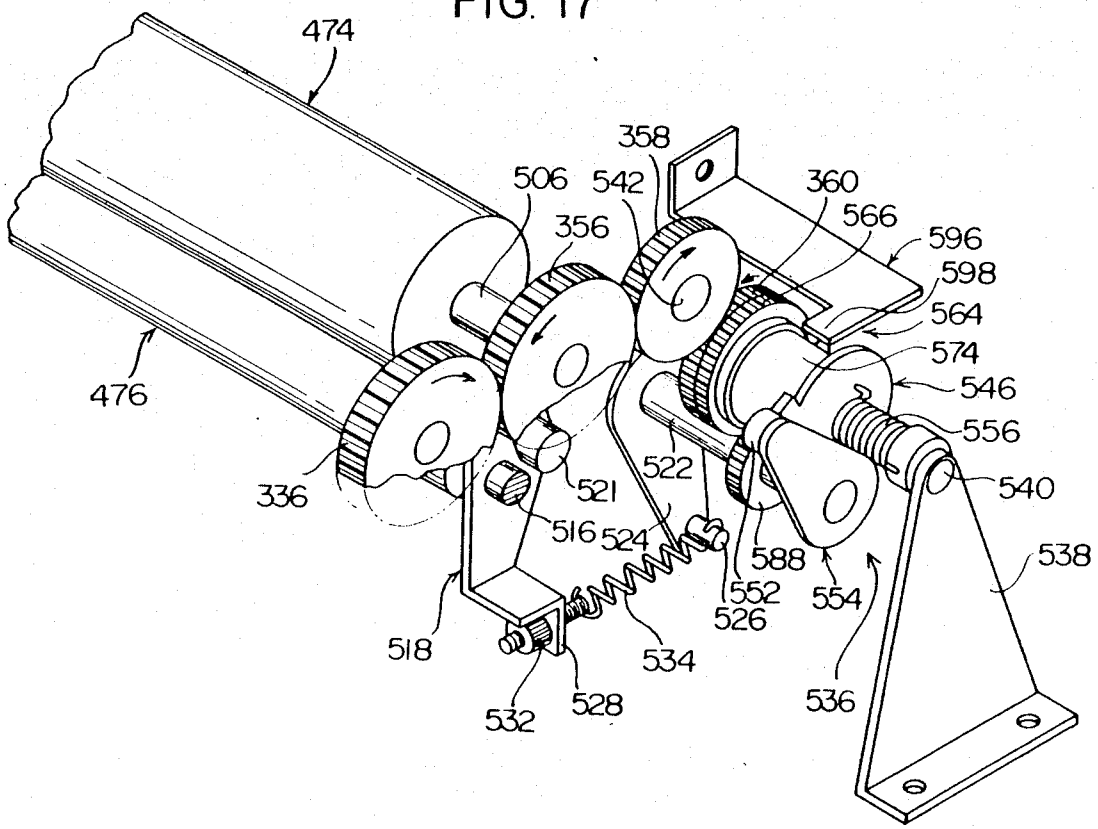
FIG. 17 is a partial perspective view of the fixing device shown in FIG. 16.
Figure 18:
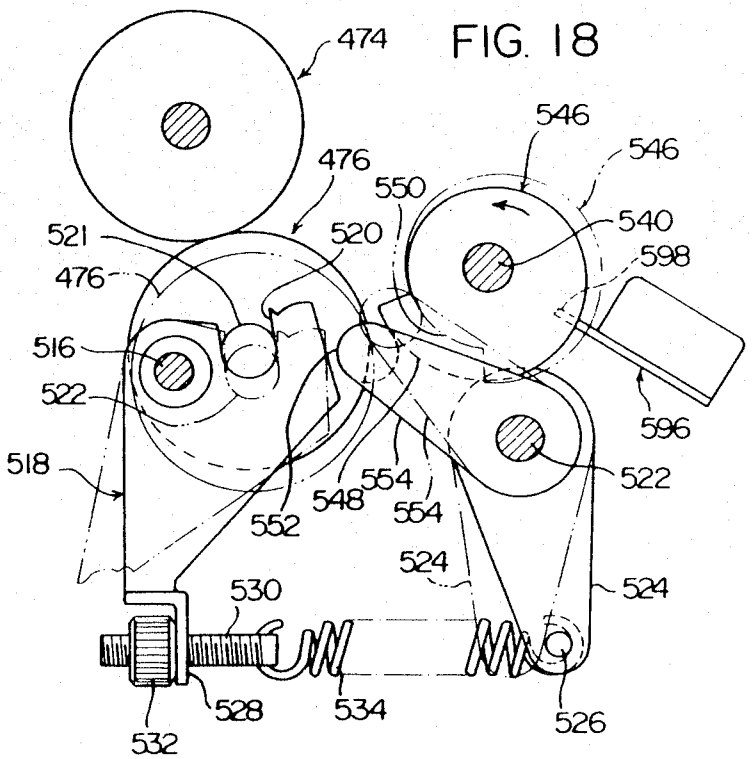
FIG. 18 is a partial simplified view showing a part of the fixing device shown in FIG. 16.

With reference to FIGS. 17 and 18 taken conjunction with FIG. 16, short shafts 516 are set firmly in the front surface of the vertical front base plate 108 and the vertical rear base plate 110 of the lower supporting frame 102 (FIGS. 16 to 18 only show the short shaft 516 at the rear surface of the vertical rear base plate 110), respectively. A movable supporting member 518 is pivotally mounted on each of the short shafts 516 (FIGS. 16 to 18 show the movable supporting member 518 mounted on the short shaft 516 set firmly in the rear surface of the vertical rear base plate 110). As will be clear from the following description, the movable supporting member 518 is pivoted about the short shaft 516 as a center between its press-contacting position shown by a solid line in FIGS. 16 and 18 and its isolated position shown by a two-dot chain line in FIGS. 16 and 18, and selectively held at the press-contacting position or the isolated position. An upwardly opened cut 520 with a semicircular shape at its lower end is formed in the movable supporting member 518. Each end portion of the supporting shaft 521 of the follower fixing roller 476 is rotatably supported by inserting it into each cut 520 of the movable supporting member 518.

With reference mainly to FIGS. 17 and 18, a shaft 522 is rotatably mounted on the vertical front base plate 108 and the vertical rear base plate 110 of the lower supporting frame 102 extending through the base plates 108 and 110 in the front-rear direction (a direction perpendicular to the sheet surface in FIG. 18). Positioning members 524 are fixed respectively to the opposite end portions of the shaft 522 (FIGS. 17 and 18 show only the positioning member 524 fixed to the rear end portion of the shaft 522). A pin 526 is firmly set in the lower end portion of each positioning member 524. On the other hand, a suspending piece 528 is formed integrally in the lower end of the movable supporting member 518. A hole is formed in the suspending piece 528, and a screw shaft 530 having an external thread formed on its peripheral surface is inserted into the hole. To one end portion (the left end portion in FIG. 18) is threadedly secured a nut member 532 which restricts the movement of the screw shaft 530 to the right in FIG. 18 relative to the suspending piece 528. A tension spring member 534 composed of a tension coil spring is stretched between the other end of the screw shaft 530 and the pin 526 set in the positioning member 524. As can be seen from the foregoing statement, the positioning member 524 fixed to the shaft 522 is moved betwen its operating position shown by a solid line in FIG. 18 and its non-operating position shown by a two-dot chain line in FIG. 18 and selectively held at either the operating or nonoperating position. When the positioning member 524 is moved from the non-operating position to the operating position, this movement is transmitted to the movable supporting member 518 via the tension spring member 534 to move the movable supporting member 518 from the isolated position shown by the two-dot chain line in FIGS. 16 and 18 to the press-contacting position shown by the solid line in FIGS. 16 and 18. As a result, as can be easily understood by referring to FIG. 18, the follower fixing roller 476 is brought into press contact with the driven fixing roller 474 by the required press-contacting force defined by the tension spring member 534. The press-contacting force can be properly adjusted by operating the nut member 532. On the other hand, when the positioning member 524 is moved from the operating position to the nonoperating position, this movement is transmitted to the movable supporting member 518 via the tension spring member 534 to move the movable supporting member 518 from the press-contacting position shown by the solid line in FIGS. 16 and 18 to the isolated position shown by the two-dot chain line in FIGS. 16 to 18. As a result, as can be easily understood from FIGS. 16 and 18, the follower fixing roller 476 over its entirety is completely separated from, or maintained out of press contact with, the driven fixing roller 474.

Figure 19:
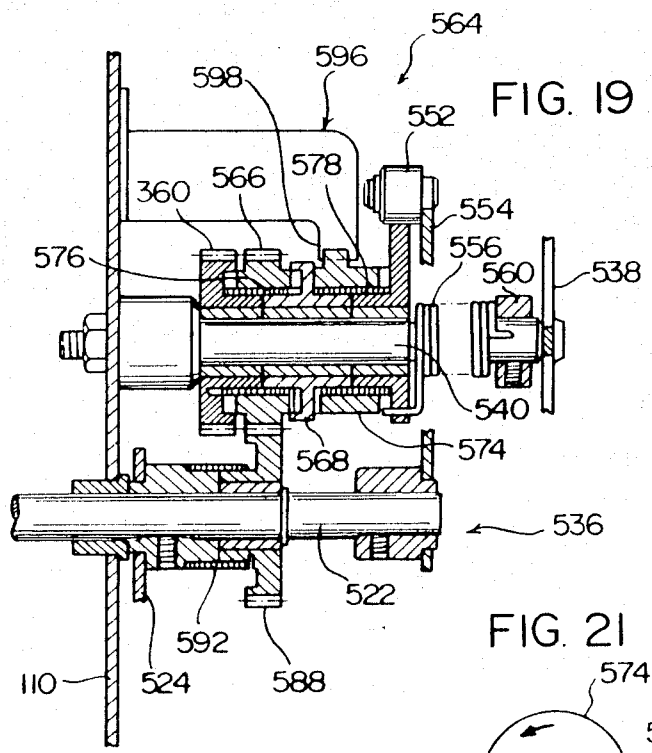
FIG. 19 is a partial sectional view showing a selective press-contacting mechanism in the fixing device shown in FIG. 16.
Figure 20:
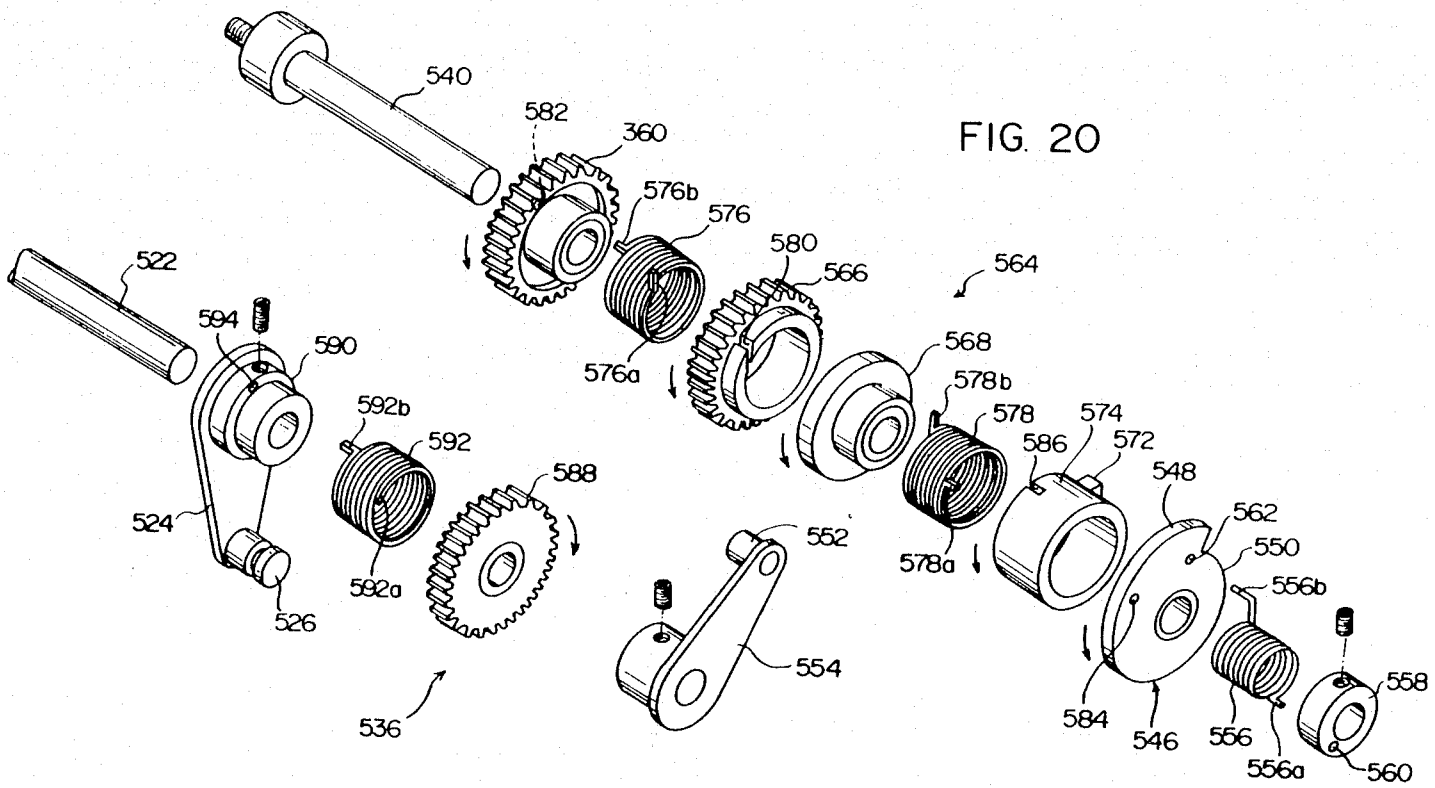
FIG. 20 is an exploded perspective view showing the selective press-contacting mechanism shown in FIG. 19.

With reference to FIGS. 19 and 20 in conjunction with FIG. 17, the positioning member 524 fixed to the shaft 522 is held at the aforesaid operating position by a moving mechanism shown generally at 536 upon energization of the drive source 308 (FIG. 1), and at the aforesaid non-operating position upon deenergization of the drive source 308. The moving mechanism 536 constitutes a selective press-contacting mechanism for selectively bringing the follower fixing roller 476 into press contact with the driven fixing roller 474 in cooperation with the positioning member 524.

The moving mechanism 536 shown in the drawing will be described in detail. An upstanding supporting member 538 is fixed to the upper surface of the bottom wall of the housing 2 at the back of the vertical rear base plate 110 of the lower supporting frame 102 (see FIGS. 1 to 3 also). A shaft 540 is fixed to, and between, the upstanding supporting member 538 and the vertical rear base plate 110. To the shaft 540 is rotatably mounted a rotating input element composed of gear 360. As can be easily understood by referring to FIG. 7 together with FIG. 17, the gear 360 is drivingly connected to the interlocking input gear 336 via the gear 358 mounted rotatably on the short shaft 542 set firmly in the vertical rear base plate 110 and the gear 356 fixed to the shaft portion of the driven fixing roller 474. Hence, when the drive source 308 (FIG. 1) is energized, the gear 360 is rotated in the direction shown by an arrow in FIGS. 17 and 20. The shaft 540 further has a cam plate 546 mounted thereon rotatably. The cam plate 546 has a first actuating portion 548 having a relatively large diameter and a second acuating portion 550 having a relatively small diameter. In relation to the cam plate 546, a cam follower member 554 having a roller 552 rotatably mounted on its free end portion is fixed to the rear end of the shaft 522 fixed to the positioning member 524. The roller 522 of the cam follower member 554 is elastically pressed against the peripheral surface of the cam plate 546 by the action of the tension spring member 534 which is stretched between the positioning member 524 and the movable supporting member 518 and exerts an action of elastically biasing the shaft 522 clockwise as viewed from the right bottom in FIG. 17. An energy storing means composed of a coil spring 556 is also annexed to the cam plate 546. As clearly shown in FIG. 20, the coil spring 556 received about the shaft 540 is wound anticlockwise as viewed from the right bottom in FIG. 20. Its one end **556*a* is fixed to a stationary tubular member 558 fixed to the shaft 540 by inserting it into a hole 560 formed in the stationary tubular member 558, and its other end 556*b* is fixed to the cam plate 546 by inserting it into a hole 562 formed in the cam plate 546**.

Figure 21:
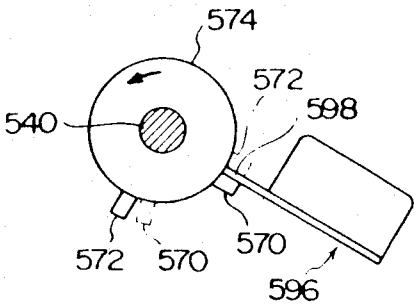
FIG. 21 is a partial simplified view showing a part of the selective press-contacting mechanism shown in FIG. 19.

A double spring clutch means 564 is interposed between the gear 360 constituting a rotating input element and the cam plate 546. With reference mainly to FIGS. 19 and 20, the double spring clutch means 564 comprises a first rotating element composed of a gear 566, a second rotating element composed of a disc 568 having a hub portion on both sides, a third rotating element composed of a cylindrical member 574 having two projections 570 and 572 (FIG. 21) formed on its peripheral surface, a first coil spring 576 and a second coil spring 578. The disc 568 is rotatably mounted on the shaft 540 between the gear 360 and the cam plate 546. The first coil spring 576 is fitted across the hub portions formed in the gear 360 and the hub portion formed on one side of the disc 568. The second coil spring 578 is fitted across the hub portion formed on the opposite side of the disc 568 and the hub portion formed in the cam plate 546. The gear 566 is received about the first coil spring 576, and the cylindrical member 574 is received about the coil spring 578. The first coil spring 576 is wound anticlockwise as viewed from the right bottom in FIG. 20. Its one end **576*a* is fixed to the gear 566 by inserting it into a slit 580 formed in an annular portion annexed to the gear 566, and its other end 576*b* is fixed to the gear 360 by inserting it into a hole 582 formed in the gear 360. The second coil spring 578 is wound anticlockwise as viewed from the right bottom in FIG. 20. Its one end 578*a* is fixed to the cam plate 546 by inserting it into a hole 584 formed in the cam plate 546, and its other end 578*b* is fixed to the cylindrical member 574 by inserting it into a slit 586 formed in the cylindrical member 574**.

The double spring clutch means 564 further includes a hampering means for hampering the rotation of the gear 566 in a direction opposite to the direction shown by an arrow, and a restricting means for restricting the rotation of the cylindrical member 574 in the direction of an arrow to a first predetermined angular position and its rotation in the direction opposite to the direction of arrow to a second predetermined angular position. The hampering means is constructed of a gear 588 mounted rotatably on the shaft 522 to which the positioning member 524 and the cam follower member 554 are fixed, and a coil spring 592 received about the hub portion of the gear 588 and the hub portion of a tubular member 590 fixed to the shaft 522. The gear 588 is in mesh with the gear 566. The coil spring 592 is wound clockwise as viewed from the right bottom in FIG. 20. Its one end **592*a* is not restrained, but its other end 592*b* is fixed to the tubular member 590 by inserting it into a hole 594 formed in the tubular member 590. The restricting means is constructed of the two projections 570 and 572 formed on the peripheral surface of the cylindrical member 574 and a stationary stop member 596 (FIGS. 17, 19 and 21) fixed to the vertical rear base plate 110. The stationary stop member 596 has a projecting portion 598 which is located in proximity to the peripheral surface of the cylindrical member 574 and interferes with the projections 570 and 572**.

The operation and effect of the selective press-contacting mechanism including the moving mechanism 536 described above will be described in summary. First, the behaviors of the selective press-contacting mechanism upon energization of the drive source 308 (FIG. 1) will be described mainly with reference to FIGS. 19 and 20. When the drive source 308 is energized, the gear 360 constituting a rotating input element drivingly connected to the drive source 308 is rotated in the direction of the arrow. As a result, the gear 566 connected to the gear 360 via the first coil spring 576 is rotated in the direction of the arrow. By the rotation of the gear 360 in the direction of the arrow, the first coil spring 576 is shrunken. Thus, the hub portion of the gear 360 is connected to the hub portion of the disc 568 by the first coil spring 576, and the disc 568 is also rotated in the direction of the arrow. When the disc 568 is rotated, the second coil spring 568 is shrunken by the force transmitted from the hub portion of the disc 568 to the second coil spring 578 wound about it. As a result, the hub portion of the disc 568 is connected to the hub portion of the cam plate 546 by the second coil spring 578, and the cam plate 546 is also rotated in the direction of the arrow. When the cam plate 546 is rotated in the direction of the arrow, the cylindrical member 574 connected to the cam plate 546 by the second coil spring 578 is also rotated in the direction shown by the arrow. When the cylindrical member 574 is rotated in the direction shown by the arrow, the projection 570 formed on the peripheral surface of the cylindrical member 574 abuts against the lower surface of the projecting portion 598 of the stationary stop member 596 as shown by a solid line in FIG. 21. Thus, the rotation in the direction of the arrow of the cylindrical member 574 and the cam plate 546 connected to the cylindrical member 574 by the second coil spring 578 is hampered, and the cylindrical member 574 and the cam plate 546 are positioned respectively at operating angular positions shown by solid lines in FIGS. 21 and 18. When the cam plate 546 is held at the operating angular position shown by the solid line in FIG. 18, the first actuating portion 548 of the cam plate 546 acts on the roller 552 of the cam follower member 554, and as a result, the cam follower member 554 is held at its angular position shown by the solid line in FIG. 18. Consequently, the positioning member 524 fixed to the shaft 522 to which the cam follower member 554 is also fixed takes the operating position shown by the solid line in FIG. 18. Hence, the movable supporting member 518 is held at its press-contacting position shown by the solid line in FIG. 18, and the follower fixing roller 476 is brought into press contact with the driven fixing roller 474.

When the cam plate 546 is rotated in the direction of the arrow to the aforesaid operating angular position, the cam plate 546 is rotated against the elastic action of the coil spring 556 having one end **556*a* fixed to the stationary tubular member 558 and the other end 556*b* fixed to the cam plate 546, and energy is stored in the coil spring 556 by the rotation of the cam plate 546. This energy tends to rotate the cam plate 546 and the cylindrical member 574 connected thereto by the second coil spring 578 in a direction opposite to the direction shown by the arrow. However, when the cam plate 546 and the cylindrical member 574 are rotated in a direction opposite to the direction of the arrow by the energy stored in the coil spring 556, the cam plate 546 and the cylindrical member 574 are returned to the aforesaid operating angular position by the rotating force in the direction of the arrow which is transmitted from the disc 568 to the cam plate 546 via the second coil spring 578. In practice, the cam plate 546 and the cylindrical member 574 repeat their slight rotation in a direction opposite to the direction of the arrow from the aforesaid operating angular position and slight rotation in the direction of the arrow to the operating angular position, and therefore, the coil spring 556** having energy stored therein repeats slight decreasing of energy and slight increasing of energy.

On the other hand, even after the cam plate 546 and the cylindrical member 574 have been held at the aforesaid operating angular position, the disc 568 continues to rotate in the direction shown by the arrow and to exert a shrinking force on the second coil spring 578. But the second coil spring 578 is restrained by the cam plate 546 and the cylindrical member 574 held at the aforesaid operating angular position, and therefore, relative rotation exists between the disc 568 and the second coil spring 578. Furthermore, when the gear 566 is rotated in the direction shown by the arrow, the gear 588 in mesh with it is also rotated in the direction shown by the arrow. When the gear 588 is rotated in the direction shown by the arrow, the coil spring 592 is extended by the force exerted on the coil spring 592 from the hub portion of the gear 588. Hence, the hub portion of the gear 588 and the hub portion of the tubular member 590 fixed to the shaft 522 are not connected to each other by the coil spring 592, and the gear 588 continues to rotate in the direction of the arrow incident to the rotation of the gear 566.

Now, the behaviors upon deenergization of the drive source 308 (FIG. 1) will be described. When the drive source 308 is deenergized, the gear 360 drivingly linked to the drive source 308 is stopped. But even after the gear 360 has been stopped, the gears 566 and 588 continue to rotate slightly in the direction of the arrow by inertia. As a result, the first coil spring 576 is extended by the force exerted on the first coil spring 576 from the gear 566. Hence, the connection of the hub portion of the gear 360 to the hub portion of the disc 568 by the first coil spring 576 is released.

On the other hand, at the time of energizing the drive source 308, the energy stored in the coil spring 556 in the above-mentioned manner rotates the cam plate 546 and the cylindrical member 574 connected to the cam plate 546 by the second coil spring 578 in a direction opposite to the direction shown by the arrow. When the cylindrical member 574 is rotated in the direction opposite to the direction of the arrow, the projecting portion 572 formed on the peripheral surface of the cylindrical member 574 abuts against the upper surface of the projecting portion 598 of the stationary stop member 596 as shown by a two-dot chain line in FIG. 21. As a result, the rotation in the direction of the arrow of the cylindrical member 574 and the cam plate 546 connected thereto by the second coil spring 578 is hampered, and the cylindrical member 574 and the cam plate 546 are held at their non-operation angular position shown by two-dot chain line in FIGS. 21 and 18. When the cam plate 546 is held at its non-operating angular position shown by the two-dot chain line in FIG. 18, the second actuating portion 550 of the cam plate 546 acts on the roller 552 of the follower member 554, and thus the cam follower member 554 is held at the angular position shown by the two-dot chain line in FIG. 18. As a result, the positioning member 524 fixed to the shaft 522 to which the cam follower member 554 is fixed is held at its non-operating position shown by the two-dot chain line in FIG. 18. Hence, the movable supporting member 518 is held at its isolated position shown by the two-dot chain line in FIG. 18, and the follower fixing roller 476 is moved away from the driven fixing roller 474.

When the cam plate 546 and the cylindrical member 574 are rotated in a direction opposite to the direction of the arrow by the energy stored in the coil spring 556, the second coil spring 578 is shrunken by the force exerted on it from the hub portion of the cam plate 546, and the hub portion of the cam plate 546 is connected to the hub portion of the disc 568. Accordingly, the disc 568 is also rotated in a direction opposite to the direction of the arrow. However, since the first coil spring 576 is extended, the hub portion of the disc 568 and the hub portion of the gear 360 are not connected to each other by the first coil spring 576. Accordingly, the cam plate 546 and the cylindrical member 574 are not connected via the second coil spring 578, the disc 568 and the first coil spring 576 to the gear 360 drivingly connected to the deenergized drive source 308, and therefore the rotation of the cam plate 546 and the cylindrical member 574 in a direction opposite to the direction of the arrow to the non-operating angular position is not hampered by the aforesaid connection to the deenergized drive source 308. In this regard, the following fact should also be noted. When the cam plate 546 and the cylindrical member 574 are rotated in a direction opposite to the direction of the arrrow, the cam follower member 554 is moved from the angular position shown by the solid line in FIG. 18 toward the angular position shown by the two-dot chain line, and consequently, the shaft 522 to which the cam follower member 554 is fixed is rotated clockwise in FIG. 18, namely clockwise as viewed from the right bottom in FIG. 20. As a result, the coil spring 592 is shrunken by the force exerted on it from the hub portion of the tubular member 590 fixed to the shaft 522, and the hub portion of the tubular member 590 and the hub portion of the gear 588 are connected to each other by the coil spring 592. Hence, the gear 588 is rotated in the direction shown by the arrow incident to the rotation of the shaft 522. The rotation of the gear 588 in the direction of the arrow causes rotation of the gear 566 in the direction of the arrow. Thus, the first coil spring 576 is surely extended by the force exerted on it from the gear 566. The rotation of the gear 588 in a direction opposite to the direction shown by the arrow is exactly hampered by the shrinking of the coil spring 592 which causes connection of the hub portion of the gear 588 to the hub portion of the tubular member 590, and therefore, the rotation of the gear 566 in mesh with the gear 588 in a direction opposite to the direction shown by the arrow is also surely hampered. Accordingly, even when the gear 566 rotates in a direction opposite to the direction of the arrow for some reason or other, any accidental shrinking of the first coil spring 576 by this rotation is surely avoided, and therefore the hub portion of the gear 360 in not accidentally connected to the hub portion of the disc 568.

Control System Relating to the Fixing Device

Figure 22:
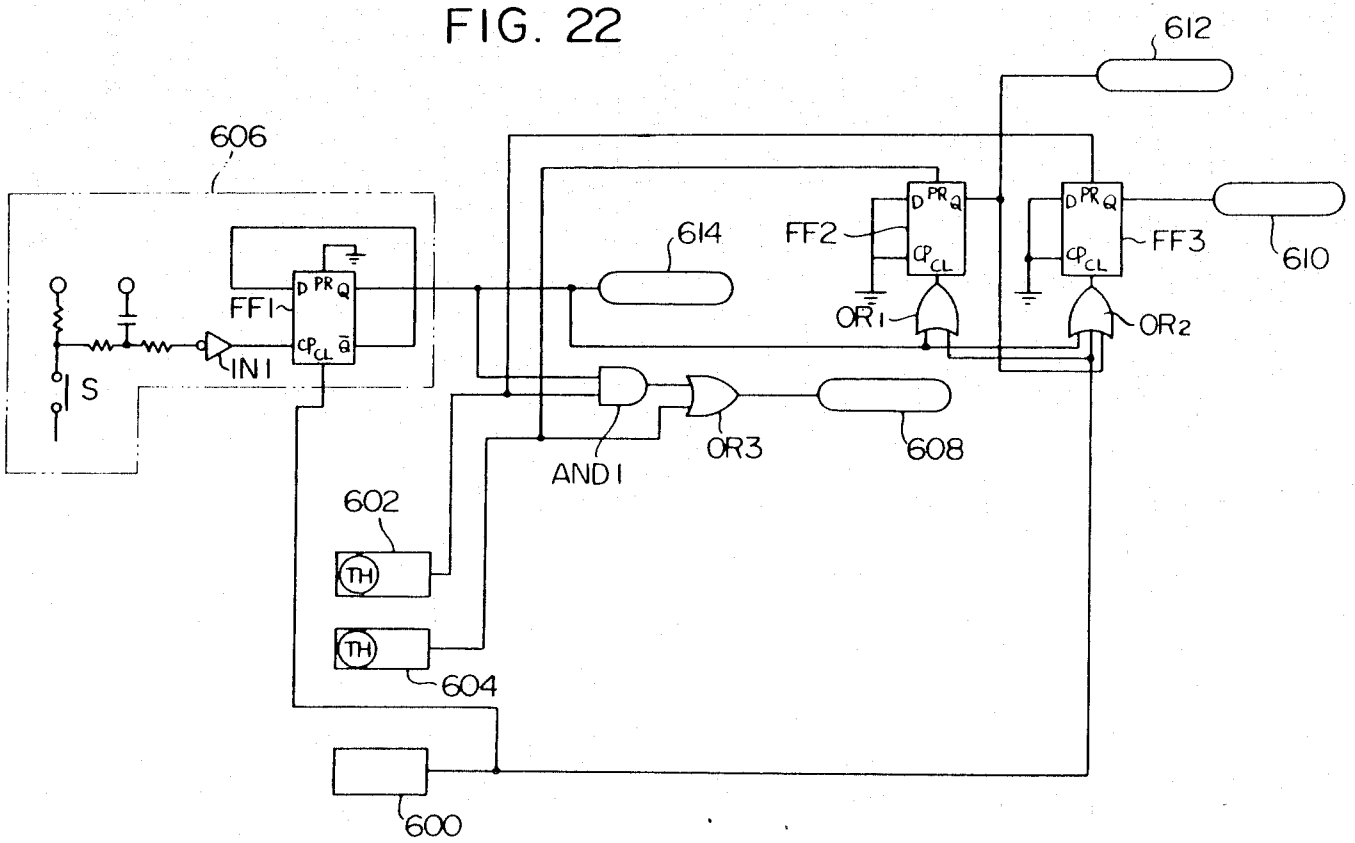
FIG. 22 is a simplified block diagram showing a control system used in relation to the fixing device in the copying apparatus shown in FIG. 1.

In the illustrated copying apparatus improved in accordance with this invention, a control system shown in a simplified form in FIG. 22 is provided in relation to the fixing device 80 (FIG. 16). The control system includes a starting means 600, a first temperature detector 602, a second temperature detector 604, a condition setting means 606, a heating control means 608, a drive control means 610, a display means 612 for indicating that the apparatus is ready for copying, and a pre-heated condition display means 614. The starting means 600 instantaneously produces a power supply closing signal "H" when a power supply switch (not shown) provided in the copying apparatus is closed. The first temperature detector 602 includes a thermistor TH located in contact with, or in proximity to, the surface of the driven fixing roller 474 (FIG. 16) in the fixing device 80 for detecting the temperature of the surface or its vicinity of the driven roller 474. The first temperature detector 602 produces a first temperature reaching signal "H" when the temperature detected by the thermistor has reached a first predetermined temperature $T_1$. The second temperature detector 604 also includes a thermistor TH located in contact with, or in proximity to, the surface of the driven fixing roller 474 for detecting the temperature of the surface or its vicinity of the driven roller 474. The thermistor TH in the first temperature detector 602 and the thermistor TH in the second temperature detector 604 may be separate from each other, or one thermistor may be used as a common thermistor for the two temperature detectors. The second temperature detector 604 produces a second temperature reaching signal "H" when the temperature detected by the thermistor TH has reached a second predetermined temperature $T_2$. The second predetermined temperature $T_2$ is higher than the first predetermined temperature $T_1$ ($T_2 > T_1$) and is set at a temperature (for example, 180° C.) for heat-fixing a toner image on a sheet material. The first predetermined temperature $T_1$ can be prescribed at a suitable point (for example, 170° C.) higher than the softening temperature of the toner. The condition setting means 606 includes a preheating switch S adapted for manual operation. When the power supply switch of the copying machine is closed, the heating control means 608 for controlling the electrical heating element 480 provided in the driving fixing roller 474 energizes the electrical heating element 480 unless a signal "H" is fed into it. When the signal "H" is fed, it deenergizes the electrical heating element 480. The drive control means 610 for controlling the drive source 308 energizes the drive source 308 when the signal "H" is fed into it. The display means 612 conveniently having a display lamp, when the signal "H" is fed, indicates that the apparatus is ready for copying. The preheating condition display means 614 conveniently having a display lamp displays a pre-heating condition when the signal "H" is fed into it.

Figure 23:
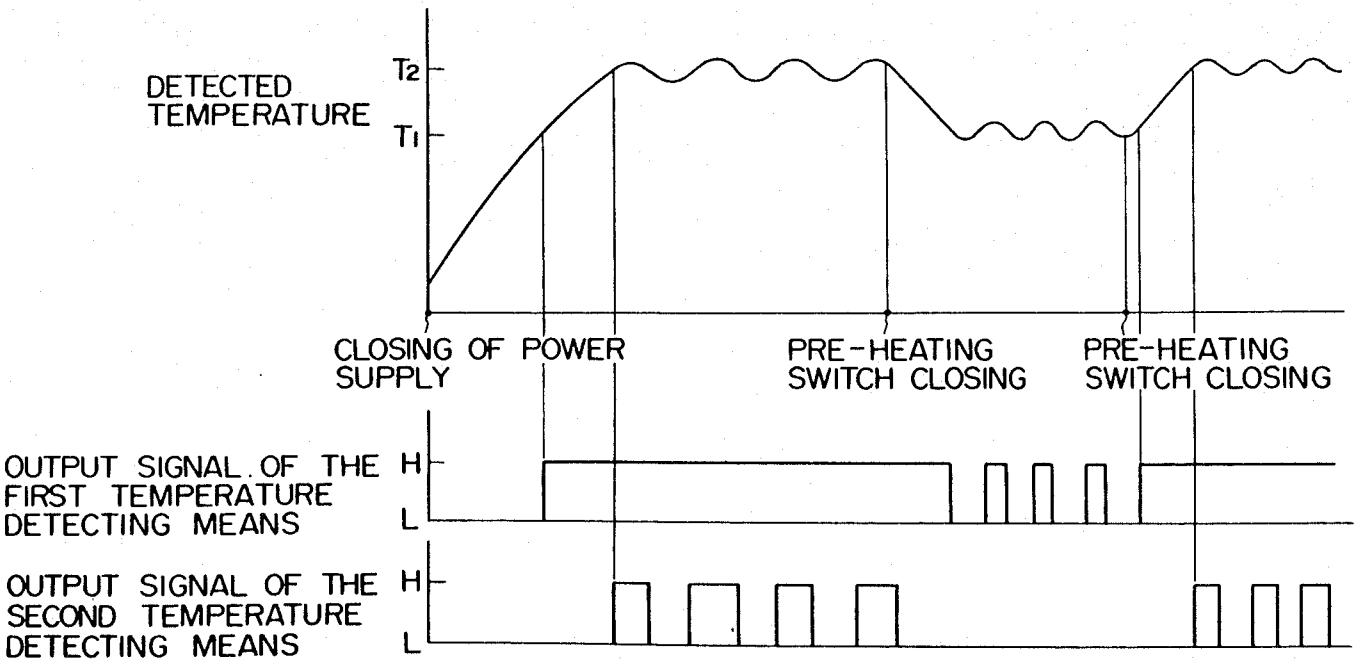
FIG. 23 is a diagram for illustrating the operation of the control system shown in FIG. 22.

The operation of the control system described above is described below with reference to FIG. 23 taken in conjunction with FIG. 22. When the power supply switch (not shown) of the copying apparatus is closed, the starting means 600 instantaneously produces a power supply closing signal "H". The signal "H" is fed into a CL input of a flip-flop FF1 in the condition setting means 606. Hence, the output signal of the condition setting means 606 (i.e., the signal of the Q output of the flip-flop FF1) becomes a normal condition signal "L", and therefore, the pre-heated condition display means 614 is not operated. The power supply closing signal produced by the starting means 600 is fed into the CL input of a flip-flop FF2 through an OR gate OR1, and also into the CL input of a flip-flop FF3 through an OR gate OR2, and thus, clears the flip-flop FF2 and the flip-flop FF3. Hence, the Q output of the flip-flop FF2 is "L", and the display means 612 for indicating that the apparatus is ready for copying is not operated. Furthermore, the Q output of the flip-flop FF2 is also "L", and the drive control means 610 does not energize the drive source 308. On the other hand, since the signal "H" is not fed into the heating control means 608, the heating control means 608 energizes the heating element 480 (FIG. 16) in the driven fixing roller 474.

When the temperature of the driven fixing roller 474 rises by the heating action of the energized heating element 480 and the temperature detected by the thermistor TH becomes a first predetermined temperature T1 or above, the first temperature detector 602 produces a first temperature reaching signal "H". This signal "H" is fed into the PR input of the flip-flop FF3 to preset the flip-flop FF3. Hence, from the Q output of the flip-flop FF3, a signal "H" is fed into the drive control means 610. As a result, the drive source 308 is energized to rotate the driven fixing roller 474 and the follower fixing roller 476 in press contact with the driven fixing roller 474. Consequently, the temperature of the surface of the driven fixing roller 474 is made sufficiently uniform over the entire peripheral surface and non-uniformity in temperature is removed. It may be possible to start energization of the drive source 308 at the time of closing the power supply switch. But this is likely to give rise to the following problem. Sometimes, the toner adhering to the previous cycle of heat fixing remains on the surface of the driven fixing roller 474. The remaining toner is not in the softened state but in the hardened state at the time of closing the power supply switch. When the driven fixing roller 474 having the solid toner remaining thereon and the follower fixing roller 476 in press contact therewith are rotated, considerable noises will be generated, or the driven fixing roller 474 and/or the follower fixing roller 476 may be damaged. In contrast, when the surface temperature of the driven fixing roller 474 has attained the first predetermined temperature $T_1$, the toner remaining fixed to the surface of the roller 474 is softened, and the above problem is obviated.

When the temperature of the driven fixing roller 474 further rises by the heating action of the energized heating element 480 and the temperature detected by the thermistor TH reaches the second predetermined temperature $T_2$, the second temperature detector 604 produces a second temperature reaching signal "H". This signal "H" is fed into the PR input of the flip-flop FF2 to pre-set the flip-flop FF2. As a result, the signal "H" is fed into the display means 612 from the Q output of the flip-flop FF2, and the display means 612 indicates that the apparatus is ready for starting the copying cycle. The signal from the Q output of the flip-flop FF2 is also fed into the CL input of the flip-flop FF3 via the OR gate OR2, whereby the flip-flop FF3 is cleared and the signal of its Q output becomes "L". Accordingly, the drive control means 610 stops energizing the drive source 308. When the surface temperature of the driven fixing roller 474 has attained the second predetermined temperature $T_2$, the ambient temperature of the fixing device 80 has also risen sufficiently. Hence, without rotating the driven fixing roller 474, no great uneveness in temperature occures on the surface of the driven fixing roller 474. When, for example, a copying cycle start switch (not shown) is closed, the drive source 308 is energized irrespective of the drive control means 610. On the other hand, the second temperature reaching signal "H" produced by the second temperature detector 604 is also fed into the heating control means 608 via an OR gate OR3 to deenergize the heating element 480. When the temperature of the driven fixing roller 474 is lowered by the deenergization of the heating element 480 and the temperature detected by the thermistor TH becomes lower than the second predetermined temperature $T_2$, the second temperature detector 604 no longer produces the second temperature reaching signal "H", and therefore, the heating control means 608 resumes energization of the heating element 480. Thus, the energization and deenergization of the heating element 480 are repeated on the basis of the second predetermined temperature $T_2$, and the temperature of the driven fixing roller 474 is maintained substantially at the second predetermined temperature $T_2$.

On the other hand, when no copying cycle is performed over a relatively long period of time, the preheating switch S of the condition setting means 606 is instantaneously closed by manual operation. As a result, the output signal of an inverter INI becomes "H", and this signal "H" is fed into the CP input of the flip-flop FF1 to set the flip-flop FF1. Consequently, the signal at the Q output of the flip-flop FF1, i.e. the output of the condition setting means 606, becomes a preheated condition signal "H". The preheated condition signal "H" is fed into the preheated condition display means 614 which then indicates that a preheated condition has been attained. The preheated condition signal "H" is also fed into the CL input of the flip-flop FF3 through the OR gate OR2. Therefore, the first temperature detector 602 produces the first temperature reaching signal "H" and thus, even when this signal "H" is fed into the PR input of the flip-flop FF3, the flip-flop FF3 is prevented from being preset. Consequently, the drive control means 610 is prevented from energizing the drive source 308. The preheated condition signal "H" is also fed into one input terminal of an AND gate AND1. Into the other input terminal of the AND gate AND1, the output signal of the first temperature detector 602 is fed. Accordingly, when the preheated condition signal "H" is produced and the first temperature detector 602 produces the first temperature reaching signal "H", the output signal of the AND gate ANDl becomes "H" and this signal "H" is fed into the heating control means 608 via the OR gate OR3 to deenergize the heating element 480. When the temperature of the driven fixing roller 474 is lowered by the deenergization of the heating element 480 and the temperature detected by the thermistor TH becomes lower than the first predetermined temperature $T_1$, the first temperature detector 602 fails to produce the first temperature reaching signal "H". Hence, the output of the AND gate AND1 becomes "L", and the energization of the heating element 480 is resumed. Thus, when the condition setting means 606 is producing the preheated condition signal "H", the energization and deenergization of the heating element 480 are repeated on the basis of the first predetermined temperature $T_1$, and the temperature of the driven fixing roller 474 is maintained substantially at the first predetermined temperature $T_1$. The first predetermined temperature $T_1$ is lower than the second predetermined temperature $T_2$. Accordingly, when the condition setting means 606 is put in condition for producing the preheated condition signal "H", the power consumed by the energization of the heating element 480 is saved.

But since the heating element 480 is not kept deenergized but its energization and deenergization are controlled on the basis of the first predetermined temperature $T_1$ and the temperature of the driven fixing roller 474 is maintained substantially at the first predetermined temperature $T_1$, the copying apparatus is returned very rapidly to a condition permitting copying when the copying cycle is resumed.

In resuming the copying cycle, the preheating switch S of the condition setting means 606 is again manually operated to close it instantaneously. As a result, the output signal of the inverter INI becomes "H", and the signal "H" is fed into the CP input of the flip-flop FF1. Since at this time the flip-flop FF1 is set and the signal to be fed from its $\overline{Q}$ output into its D input is "L", the flip-flop FF1 is reset by the feeding of the signal "H" into the CP input. Hence, the Q output of the flip-flop FF1, i.e. the output of the condition setting means 606, is returned to a normal condition signal "L". As a result, the signal fed into the preheated condition display means 614 becomes "L", and the operation of the preheated condition display means 614 is stopped. Furthermore, the signal fed into one input of the AND gate AND1 also becomes "L". Thus, even when the first temperature detector 602 produces the first temperature arrival signal "H", the output signal of the AND gate AND1 does not become "H", and therefore, the heating element 480 is not deenergized. Furthermore, since the signal fed into the CL input of the flip-flop FF3 via the OR gate OR2 becomes "L", when the first temperature detector 602 produces the first temperature arrival signal "H", this signal "H" is fed into the PR input of the flip-flop FF3 to preset the flip-flop FF3. Consequently, the drive control means 610 energized the drive source 308. When the temperature of the driven fixing roller 474 rises as a result of the continued energization of the heating element 480 and the temperature detected by the thermistor TH becomes the second predetermined temperature $T_2$ and the second temperature detector 604 produces the second temperature reaching signal "H", the display means 612 for indicating the readiness of starting the copying cycle is operated as described above, and the drive source 308 is deenergized to deenergize the heating element 480.

Although not shown in the drawing, it is possible, if desired, to provide in relation to the preheating switch S of the condition setting means 606 a suitable detecting means which, when the copying cycle is not performed for a period longer than a predetermined one while the output signal of the condition setting means 606 is a normal condition signal "L", detects this condition and instantaneously closes the preheating switch S automatically, thus changes the condition of the condition setting means 606, and converting its output signal to a preheated condition signal "H".

Sheet Material Conveying Mechanism

Figure 24:
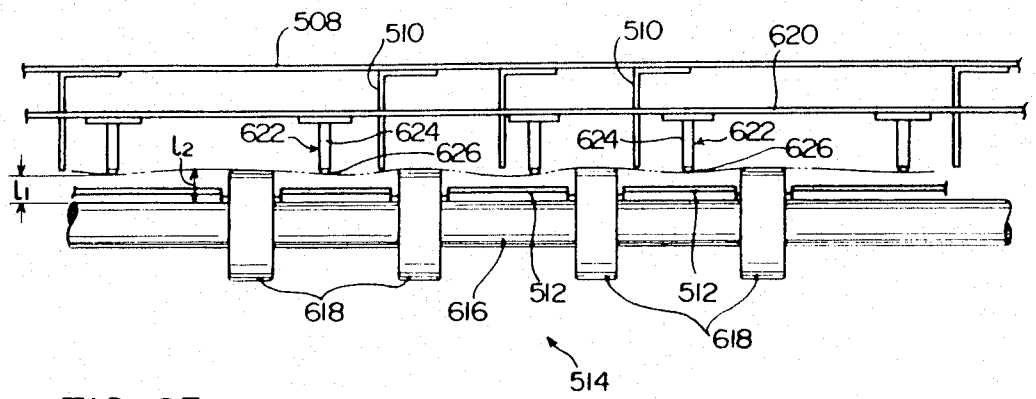
FIG. 24 is a partial sectional view showing a sheet material conveying mechanism in the copying apparatus shown in FIG. 1.

Now, with reference to FIG. 24 taken in conjunction with FIG. 16, there will be described a sheet material conveying mechanism shown generally at 514 which is provided to convey a sheet material such as copying paper fed from the fixing device 80 further downstream (to the left in FIG. 16) and discharge it into the receiving tray 84 through the opening 82 formed in the left wall of the housing 2. A driven shaft 616 extending in the front-rear direction is rotatably mounted between the vertical front base plate 108 and the vertical rear base plate 110 (see FIG. 3) of the lower supporting frame 102. The rear end portion of the driven shaft 616 projects rearwardly beyond the vertical rear base plate 110, and the gear 362 (FIG. 7) is fixed to this rear end portion. As clearly shown in FIG. 7, the gear 362 is drivingly connected to the interlocking input gear 336 through the gears 360, 358 and 356 already described hereinabove. Accordingly, the gear 362 is further drivingly connected to the output shaft 314 of the drive source 308 (FIG. 1) via the interlocking linking gear 334 and the interlocking output gear 332, and upon energization of the drive source 308, rotated in the direction shown by the arrow. As is clearly shown in FIG. 24, a plurality of conveying rollers 618 spaced from each other longitudinally are fixed to the driven shaft 616. The sheet material conveying mechanism 514 further includes a supporting plate 620 fixed above the driven shaft 616 between the vertical front base plate 108 and the vertical rear base plate 110 of the lower supporting frame 102. A plurality of stationary guide members 622 spaced from each other in the front-rear direction (the left-right direction in FIG. 24, i.e. the direction perpendicular to the sheet surface in FIG. 16) are fixed to the lower surface of the supporting plate 620. Each of the stationary guide members 622 has a suspending portion 624 suspending from the lower surface of the supporting plate 620 and a guide portion 626 extending from the lower end of the suspending portion 624 in the sheet conveying direction (i.e., the left direction in FIG. 16, or the direction perpendicular to the sheet surface in FIG. 24). It is important that the guide portion 626 of each stationary guide member 622 should not be positioned in vertical alignment with the conveying roller 618 fixed to the driven shaft 616, but should be positioned opposite to the driven shaft 616 between the adjacent conveying rollers 618. In addition, it is important that the lower end edge of the guide portion 626 of each stationary guide member 622 should be postioned projecting toward the driven shaft 616 beyond the peripheral surface of the conveying roller 618, and the distance $l_1$ between the lower end edge of the guide portion 626 and the peripheral surface of the driven shaft 616 should be slightly shorter than the length $l_2$ from the peripheral surface of the driven shaft 616 to the peripheral surface of the conveying roller 618. As will be clear from the following description, the upper surface of the sheet material conveyed by the sheet material conveying mechanism 514 is brought into contact with the lower end edge of the guide portion 626 of each stationary guide member 622. To achieve smooth conveying of the sheet material, it is desirable to minimize a frictional resistance exerted on the upper surface of the sheet material by the lower end edge of the guide portion 626. From this standpoint, at least the lower end edge of the guide portion 626 of each stationary guide member 622 is formed preferably of a plastic material having a low coefficient of friction. Furthermore, at least the lower end edge of the guide portion 626 of the stationary guide member 622 preferably has a smooth semicircular cross-sectional shape.

In the sheet material conveying mechanism 514 described above, a sheet material such as copying paper delivered from the fixing device 80 is introduced between the conveying rollers 618 and the guide portions 626 of the stationary guide members 622. As a result, as shown by a two-dot chain line in FIG. 24, the sheet material is made wavelike in the widthwise direction by the cooperative action of the peripheral surfaces of the conveying rollers 618 and the lower end edges of the guiding portions 626. The sheet material is delivered downstream by the conveying action of the conveying rollers 618 rotating in the direction shown by the arrow. Since the sheet material is delivered in a wave-like form in its widthwise direction, its stiffness in the conveying direction is considerably increased even when the sheet material itself has low stiffness. Hence, the leading edge of the sheet material is prevented from sagging downwardly immediately downstream of the sheet material conveying mechanism 514 and failing to be discharged as required, and the sheet material can be surely and stably discharged onto the receiving tray 84 while avoiding inconveniences such as the one mentioned above.

In a conventional copying apparatus, a sheet material conveying mechanism including a driven shaft having a plurality of longitudinally spaced conveying rollers mounted thereon and a follower shaft having a plurality of longitudinally spaced guide rollers mounted thereon is used for discharging the sheet material delivered from the fixing device into the receiving tray. The guide rollers are not positioned in vertical alignment with the conveying rollers, and each guide roller is positioned between adjacent conveying rollers, and the peripheral surface of each guide roller projects toward the driven shaft beyond the peripheral surface of the conveying roller. In such a conventional sheet conveying mechanism, too, the sheet material is delivered after it is made wavelike in the widthwise direction by the cooperative action of the conveying rollers and the guide rollers, and is therefore discharged onto the receiving tray as required. However,the conventional sheet material conveying mechanism has the defect of being relatively expensive because of the presence of the follower shaft and a relatively large number of guide rollers mounted on it. In contrast, the sheet material conveying mechanism 154 improved in accordance with this invention can fully perform its required function in spite of the fact that it is simpler and less costly than the conventional sheet conveying mechanism.

Figure 25:
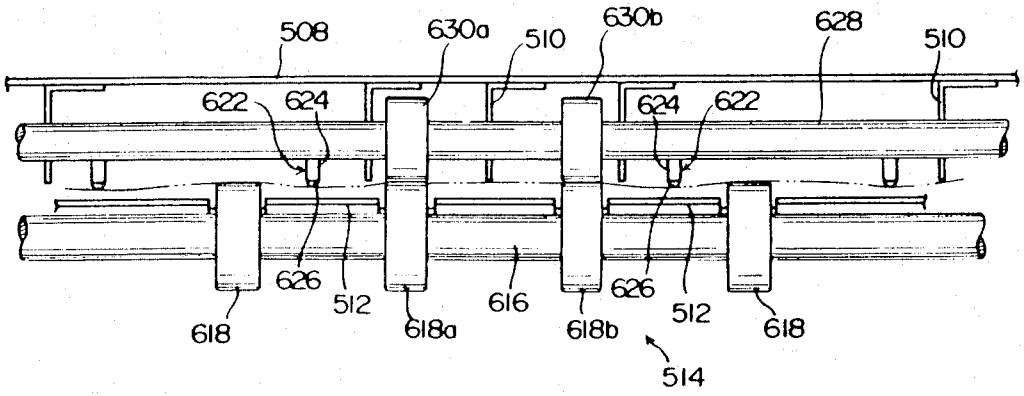
FIG. 25 is a partial sectional view showing a modified example of the sheet material conveying mechanism.

FIG. 25 shows a modified example of the sheet conveying mechanism improved in accordance with this invention. In the aforesaid conventional sheet material conveying mechanism and the sheet conveying mechanism 514 improved in accordance with this invention, conveying of the sheet material relies only on the action of the conveying rollers 618 contacting the lower surface of the sheet material. Hence, conveying of the sheet material is not always sure. If a sheet material detector such as a microswitch is provided downstream or upstream of the sheet material conveying mechanism 514, conveying of the sheet material may be hampered by the sheet material detector, or the sheet material may detour from the sheet material detector thus not actuating it.

The modified example shown in FIG. 25 gives a solution to such a problem. In the embodiment shown in FIG. 25, the following constitutent elements are added to the constituent elements in the embodiment shown in FIG. 24. Specifically, a shaft 628 is rotatably mounted above, and opposite to, the driven shaft 616. To the shaft 628 are fixed two auxiliary conveying rollers 630*a* and 630*b* which are positioned to two specified conveying rollers 618*a* and 618*b*, preferably two adjacently positioned specified conveying rollers 618*a* and 618*b*, fixed to the driven shaft 616 and cooperating with these two specified conveying rollers 618*a* and 618*b*. If desired, it is possible to fix the shaft 628 and mount the auxiliary conveying rollers 630*a* and 630*b* rotatably on the fixed shaft 628. In the modified example shown in FIG. 25, the stationary guide member 622 is omitted between the two specified conveying rollers 618*a* and 618*b*.

In the above-described modified example, the sheet material is made wavelike by the cooperative action of the peripheral surfaces of the conveying rollers 618 and the lower edges of the guide member portions 626 of the stationary guide members 622 in an area other than the two specified copying rollers 618*a* and 618*b*, as shown by a two-dot chain line in FIG. 25, and therefore, the stiffness of the sheet material in the conveying direction is increased. On the other hand, in the area of the two specified conveying rollers 618*a* and 618*b*, the sheet material is not made wavelike but is maintained flat, and it is conveyed while being nipped by the conveying rollers 618*a* and 618*b* and the auxiliary conveying rollers 630*a* and 630*b*. In the modified embodiment shown in FIG. 25, the conveying of the sheet material is ensured by the nipping of the conveying rollers 618*a* and 618*b* and the auxiliary conveying rollers 630*a* and 630*b*, and therefore, the sheet material is surely conveyed. Furthermore, in the area of the two specified conveying rollers 618*a* and 618*b*, the displacement or bending of the sheet material is prevented by the nipping of the conveying rollers 618*a* and 618*b* and the auxiliary conveying rollers 630*a* and 630*b*. Accordingly, if a detecting arm of a sheet material detector (not shown) or the like is provided downstream or upstream of the two specified conveying rollers 618*a* and 618*b*, the sheet detector can be operated surely by the sheet material.

While one specific example of the electrostatic copying apparatus improved in various respects by the present invention has been described in detail, it should be understood that the present invention is not limited to such a specific embodiment, and various changes and modifications are possible without departing from the scope of the invention.

What is claimed is:

1. A copying paper feed device for an electrostatic copying apparatus, said device comprising:

a copying paper cassette receiving section adapted for loading thereinto of a copying paper cassette having a box like cassette case with an upper surface, a front end, a bottom plate disposed within the cassette case on which to place a layer of copying paper sheets, and spring means for elastically biasing the front end portion of the bottom plate upwardly, the cassette case being open at least at the front end portion of the upper surface, the loading of the cassette into the cassette receiving section being by inserting at least the front end portion of the cassette into the cassette receiving section;

a shaft rotatably mounted within the cassette receiving section and adapted to be drivingly connected to a drive source;

a feed roller mounted on the rotatable shaft so that when a copying paper cassette is properly loaded into the cassette-receiving section, the front end portion of the uppermost copying paper sheet of the copying paper sheet layer is brought into press contact with the feed roller by the elastic biasing action of the spring member; and clutch means and a rotatable input element drivingly connected to the drive source to be interposed between the rotatable shaft and the drive source, the clutch means in an operating condition linking the rotatable input element to the rotatable shaft so as to rotate the rotatable shaft in the feeding direction incident to the rotation of the rotatable input element, the clutch means in a non-operating condition permitting the rotatable shaft to rotate freely in the feeding direction and in a direction opposite to the feeding direction with respect to the rotatable input element, the clutch means comprising a second rotatable element, a coil spring received about a hub portion of the rotatable input element and a hub portion of the rotatable shaft and wrapped from its one end connected to the rotatable input element to its other end connected to the second rotatable element in a direction in which the coil spring is shrunken when the rotatable input element is rotated in the feeding direction relative to the second rotatable element, a friction member mounted for free movement between an operating position at which the friction member frictionally contacts the second rotatable element to resist the rotation of the second rotatable element and a non-operating position at which the friction member is isolated from the second rotatable element, and control means for selectively positioning the friction member at one of the operating position and the non-operating position.

2. The copying paper feed device of claim 1 further comprising a guide member within the cassette-receiving section to act on the leading edge portion of the uppermost copying paper sheet in the paper layer when a cassette having a paper layer therein is inserted into the cassette-receiving section to displace the front end portion of the paper sheet layer downwardly against the elastic action of the spring means, thereby preventing or reducing the contacting of the leading edge portion of the uppermost copying paper sheet in the paper layer with the feed roller.

3. The copying paper feed device of claim 2 wherein the guide member comprises an irregular arcuate member rotatably mounted on said rotatable shaft or a shaft extending substantially parallel, and in proximity, to said rotatable shaft and having a guiding arcuate portion extending radially beyond the peripheral surface of the feed roller and a non-operating portion radially retracted from the peripheral surface of the feed roller so that when the cassette is not loaded in the cassette-receiving section, the irregular arcuate member is at an angular position at which the guiding arcuate portion is located below the non-operating portion, and when the cassette is inserted into the cassette-receiving section, the uppermost copying paper sheet in the paper sheet layer contacts the guiding arcuate portion whereby the irregular arcuate member is rotated and brought to an angular position at which a boundary portion between the guiding arcuate portion and the non-operating portion contacts the uppermost copying paper sheet.

4. The copying paper feed device of claim 2 wherein the guide member comprises a stationary guide plate having a guiding lower edge extending inclinedly downwardly in the inserting direction of the cassette to a front end portion located slightly above the lower end of the peripheral surface of the feed roller.

* * * * *